US012089690B2

(12) United States Patent
Hishikawa et al.

(10) Patent No.: US 12,089,690 B2
(45) Date of Patent: Sep. 17, 2024

(54) SHOE SOLE AND SHOE HAVING SHOE SOLE

(71) Applicant: ASICS CORPORATION, Kobe (JP)

(72) Inventors: Fumitomo Hishikawa, Kobe (JP); Hiroaki Nishimura, Kobe (JP); Shingo Takashima, Kobe (JP); Yuya Kozuka, Kobe (JP)

(73) Assignee: ASICS CORPORATION, Kobe (JP)

( * ) Notice: Subject to any disclaimer, the term of this patent is extended or adjusted under 35 U.S.C. 154(b) by 29 days.

(21) Appl. No.: 17/464,588

(22) Filed: Sep. 1, 2021

(65) Prior Publication Data

US 2022/0061458 A1 Mar. 3, 2022

(30) Foreign Application Priority Data

Sep. 3, 2020 (JP) ..... 2020-148216

(51) Int. Cl.
*A43B 13/14* (2006.01)

(52) U.S. Cl.
CPC ..... *A43B 13/14* (2013.01)

(58) Field of Classification Search
CPC ... A43B 13/122; A43B 13/127; A43B 13/145; A43B 13/37; A43B 13/026; A43B 13/04;
(Continued)

(56) References Cited

U.S. PATENT DOCUMENTS 6,389,713 B1 * 5/2002 Kita ..... A43B 13/18 36/31
7,016,867 B2 * 3/2006 Lyden ..... A43B 13/36 36/38

(Continued)

FOREIGN PATENT DOCUMENTS

JP 2006334400 A 12/2006
JP 2018202196 A 12/2018

(Continued)

OTHER PUBLICATIONS

European Search Report for EP Application No. 21190643.3, dated Jan. 26, 2022, 9 pp. [300.04EP (EPSR)].

(Continued)

*Primary Examiner* — Bao-Thieu L Nguyen
(74) *Attorney, Agent, or Firm* — KONRAD, RAYNES, DAVDA & VICTOR LLP; Alan S. Raynes

(57) ABSTRACT

A shoe sole includes a sole body portion and a plate portion. The sole body portion is located to continuously extend from a front foot portion to a rear foot portion. The plate portion is located to continuously extend from the front foot portion to the rear foot portion, joined to the sole body portion, and formed of a material higher in rigidity than a material forming the sole body portion. The plate portion includes an exposed region and an accommodated region. The exposed region forms a ground contact surface of the shoe sole at least in the front foot portion. The accommodated region is accommodated inside the sole body portion at least in the rear foot portion. In at least a part of the middle foot portion and at least a part of the rear foot portion, the plate portion is inclined upward as it extends rearward.

21 Claims, 27 Drawing Sheets

(58) Field of Classification Search
CPC ... A43B 13/183; A43B 13/185; A43B 13/186; A43B 13/12; A43B 13/181; A43B 13/187; A43B 23/0245
See application file for complete search history.

(56) References Cited

U.S. PATENT DOCUMENTS

| | | | | |
|---|---|---|---|---|
| 9,339,079 | B2 * | 5/2016 | Lucas | A43B 13/187 |
| 10,441,027 | B2 * | 10/2019 | Bartel | A43B 7/148 |
| 10,842,224 | B2 * | 11/2020 | Farina | A43B 13/127 |
| 11,478,039 | B2 * | 10/2022 | Paulson | A43B 13/026 |
| 2007/0277401 | A1 | 12/2007 | Young-Chul | |
| 2008/0244932 | A1 * | 10/2008 | Nau | A43B 3/0036 36/102 |
| 2009/0019730 | A1 * | 1/2009 | Salminen | A43B 7/1425 36/102 |
| 2009/0056172 | A1 | 3/2009 | Cho | |
| 2012/0036740 | A1 | 2/2012 | Gerber | |
| 2012/0216424 | A1 * | 8/2012 | Lyden | A43B 13/36 36/100 |
| 2013/0333251 | A1 | 12/2013 | Taniguchi et al. | |
| 2017/0079373 | A1 | 3/2017 | Huard et al. | |
| 2017/0095033 | A1 | 4/2017 | Farina et al. | |
| 2017/0095034 | A1 | 4/2017 | Dupre et al. | |
| 2018/0132564 | A1 * | 5/2018 | Bruce | A43B 13/189 |
| 2018/0168281 | A1 * | 6/2018 | Case | A43B 13/026 |
| 2018/0263335 | A1 * | 9/2018 | Iuchi | A43B 13/122 |
| 2019/0320759 | A1 * | 10/2019 | Conrad | A43B 13/181 |
| 2019/0387837 | A1 | 12/2019 | Luh | |
| 2020/0022452 | A1 | 1/2020 | Hatano et al. | |
| 2021/0037911 | A1 * | 2/2021 | Paulson | A43B 13/127 |

FOREIGN PATENT DOCUMENTS

| | | | |
|---|---|---|---|
| KR | 102097381 | B1 | 4/2020 |
| WO | 2012127556 | A1 | 9/2012 |
| WO | 2016163393 | A1 | 10/2016 |
| WO | 2018123509 | A1 | 7/2018 |

OTHER PUBLICATIONS

Japanese Office Action dated Feb. 28, 2024, 6 pp., for Application No. 2020-148216.

* cited by examiner

SHOE SOLE AND SHOE HAVING SHOE SOLE

This nonprovisional application is based on Japanese Patent Application No. 2020-148216 filed on Sep. 3, 2020 with the Japan Patent Office, the entire contents of which are hereby incorporated by reference.

BACKGROUND OF THE INVENTION

Field of the Invention

The present invention relates to a shoe sole and a shoe having the shoe sole.

Description of the Background Art

Prior art documents disclosing configurations of a shoe sole and a shoe having the shoe sole include WO 2018/123509, WO 2012/127556, WO 2016/163393, and U.S. Patent Application Publication No. 2017/0095034.

In a shoe sole disclosed in WO 2018/123509, a midsole defines a tunnel-shaped or groove-shaped cavity extending in the front-rear direction of a shoe. A shoe sole disclosed in WO 2012/127556 is a spike sole including a sole body made of fiber-reinforced plastic (FRP) reinforced with reinforcing fibers and having multiple spikes. A shoe sole disclosed in WO 2016/163393 includes a rigid sole body containing a non-foaming resin component. According to a shoe sole disclosed in the specification of U.S. Patent Application Publication No. 2017/0095034, a sole structure includes a plate disposed between an outsole and an upper. The plate has a recessed portion extending between a foremost point and a rearmost point and having a constant radius of curvature from the foremost point to a metatarsophalangeal joint (MTP) point of the sole structure.

SUMMARY OF THE INVENTION

Some of the conventional shoe soles of shoes are improved in running performance by including a plate portion having flexural rigidity against the load received from a foot of a wearer of the shoes during running of this wearer (it should be noted that a shoe sole disclosed in WO 2018/123509 does not include a plate portion, and WO 2012/127556 and WO 2016/163393 each disclose a relatively rigid sole body but fails to disclose flexural rigidity of the sole body). For example, a plate disclosed in U.S. Patent Application Publication No. 2017/0095034 has longitudinal rigidity that reduces energy loss in proximity to an MTP joint of a foot. This reduces the load on an ankle joint. However, by appropriately designing the shape and rigidity of such a plate portion provided in a shoe sole, the running performance by shoes still can be further improved.

The present invention has been made in view of the above-described problems, and an object of the present invention is to provide a shoe sole for improving the running performance by shoes.

A shoe sole according to the first aspect of the present invention has: a front foot portion that supports a toe portion and a ball portion of a foot of a wearer; a middle foot portion that supports an arch portion of the foot; and a rear foot portion that supports a heel portion of the foot, in which the front foot portion, the middle foot portion, and the rear foot portion are connected in a front-rear direction. The shoe sole includes a sole body portion and a plate portion. The sole body portion is located to continuously extend from the front foot portion to the rear foot portion. The plate portion is located to continuously extend from the front foot portion to the rear foot portion, joined to the sole body portion, and formed of a material that is higher in rigidity than a material forming the sole body portion. The plate portion has an exposed region and an accommodated region. The exposed region forms a ground contact surface of the shoe sole at least in the front foot portion. The accommodated region is accommodated inside the sole body portion at least in the rear foot portion. In at least a part of the middle foot portion and at least a part of the rear foot portion, the plate portion is inclined upward as the plate portion extends rearward.

A shoe sole according to the second aspect of the present invention has: a front foot portion that supports a toe portion and a ball portion of a foot of a wearer; a middle foot portion that supports an arch portion of the foot; and a rear foot portion that supports a heel portion of the foot, in which the front foot portion, the middle foot portion, and the rear foot portion are connected in a front-rear direction. The shoe sole includes a sole body portion and a plate portion. The sole body portion is located to continuously extend from the front foot portion to the rear foot portion. The plate portion extends at least in the front foot portion in the front-rear direction, is joined to the sole body portion, and is formed of a material that is higher in rigidity than a material forming the sole body portion. The plate portion includes a lateral foot side region, a medial foot side region, and a rear side region. The lateral foot side region extends in the front-rear direction and supports a lateral foot side of the foot of the wearer. The medial foot side region extends in the front-rear direction and supports a medial foot side of the foot of the wearer. In the front foot portion, at least a part of the medial foot side region is spaced apart from the lateral foot side region in a foot width direction. The rear side region is located at least in a rear end portion of the plate portion, and connects the lateral foot side region and the medial foot side region.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
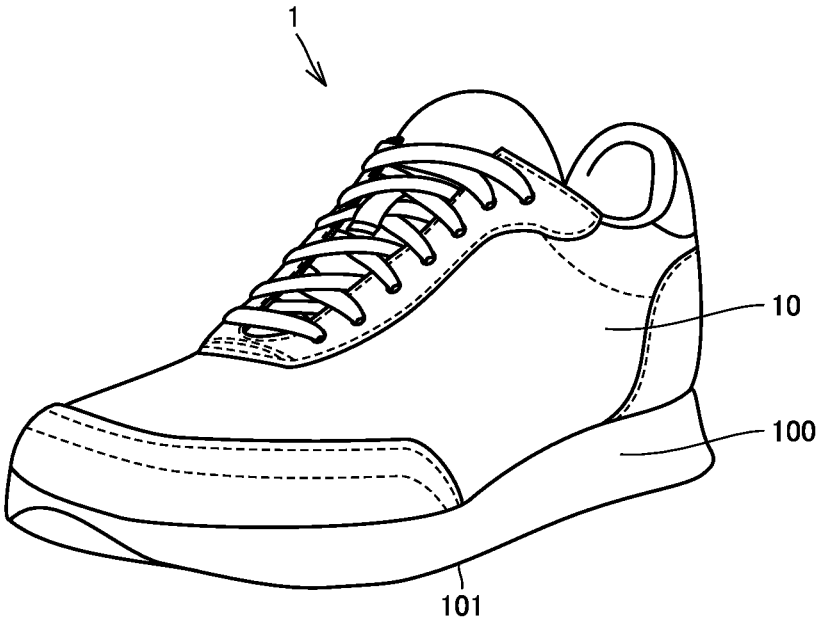
FIG. 1 is a perspective view showing a shoe according to one embodiment of the present invention.

Hereinafter, a shoe sole and a shoe having the shoe sole according to one embodiment of the present invention and modifications thereof will be described with reference to the accompanying drawings. In the following description of the embodiments and modifications, the same or corresponding portions in the accompanying drawings will be denoted by the same reference characters, and the description thereof will not be repeated.

As used herein, an "up-down direction" means a direction orthogonal to the ground when a shoe sole is placed on a flat ground such that a ground contact surface of the shoe sole is in contact with the ground, "upward" means a direction opposite to the ground when viewed from the shoe sole, and "downward" means a direction toward the ground when viewed from the shoe sole. As used herein, "front" or "forward" means a direction in which a wearer of shoes faces, "rear" or "rearward" means a direction opposite to "front" or "forward", and the "front-rear direction" means a direction extending "forward" and "rearward" As used herein, a "foot width direction" is a direction orthogonal to both the "up-down direction" and the "front-rear direction".

When simply referred to as a "medial foot side" in the description of the shoe sole, it means the side of a portion of the shoe sole that supports the medial foot side (a medial side of the foot in anatomical position) of the foot of a wearer of a shoe with respect to the center in the foot width direction of the shoe sole. When simply referred to as a "lateral foot side", it means the side of a portion of the shoe sole that supports the lateral foot side (the side opposite to the medial side of the foot in anatomical position) of the foot of a wearer of a shoe with respect to the center of the shoe sole in the foot width direction.

In the present specification, the term "support(ing) a foot of a wearer (a wearer's foot)" is not limited to the meaning of supporting the wearer's foot while being in direct contact with the foot, but includes the meaning of supporting the wearer's foot from below the wearer's foot with another member interposed therebetween. The description of the configurations of the shoe and the shoe sole in the present specification explains each configuration in the state in which a wearer does not wear shoes, except for the state in which the wearer is running.

One Embodiment

FIG. 1 is a perspective view showing a shoe according to one embodiment of the present invention. As shown in FIG. 1, a shoe 1 includes a shoe sole 100 and an upper 10 located above the shoe sole 100. The shoe sole 100 supports a foot of a wearer of the shoe 1 mainly from below. The upper 10 holds the foot of the wearer wearing the shoe 1 mainly from the side and from above. The upper 10 is joined to the shoe sole 100.

Figure 2:
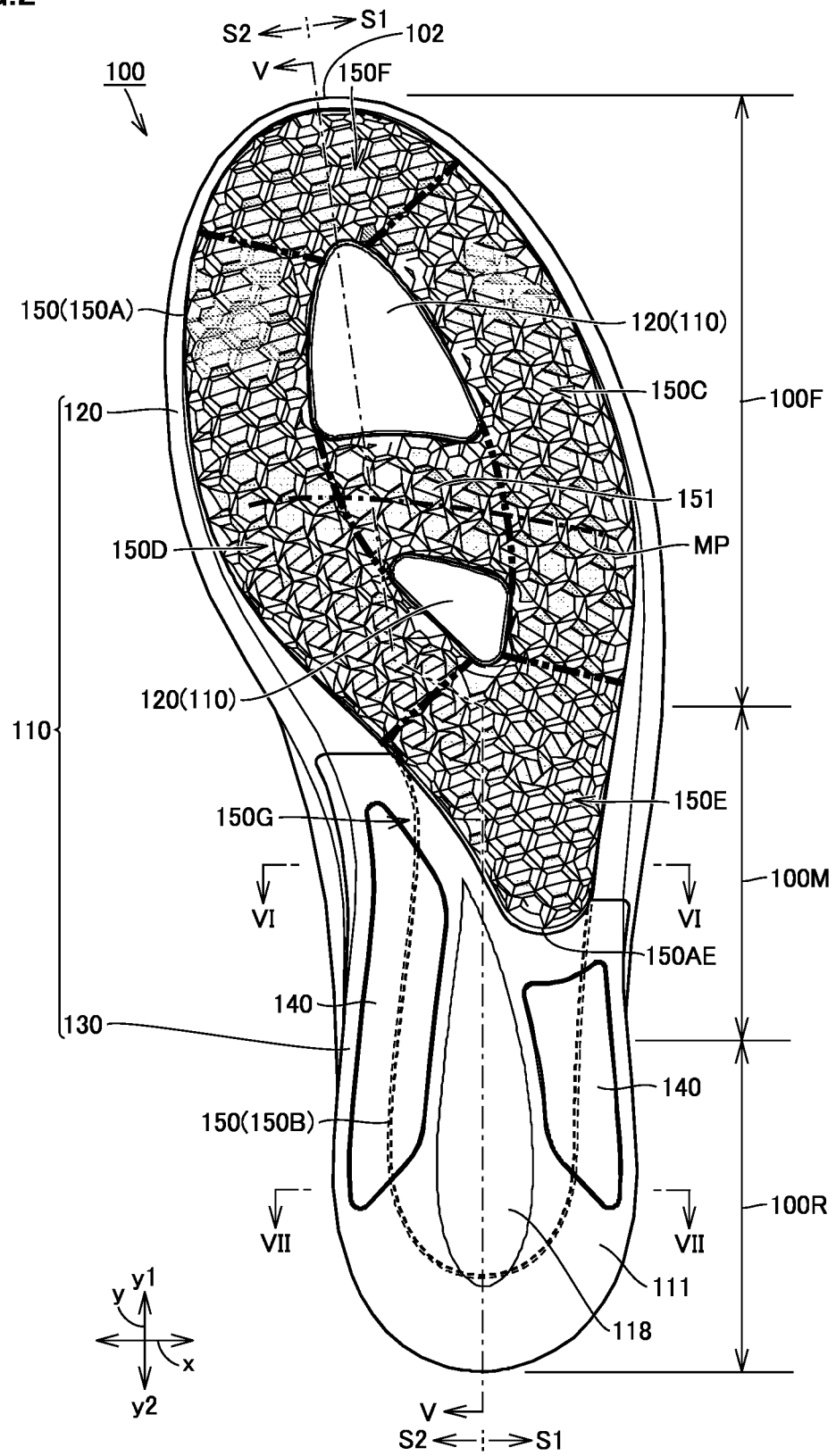
FIG. 2 is a bottom view showing a shoe sole according to one embodiment of the present invention as viewed from below.
Figure 3:
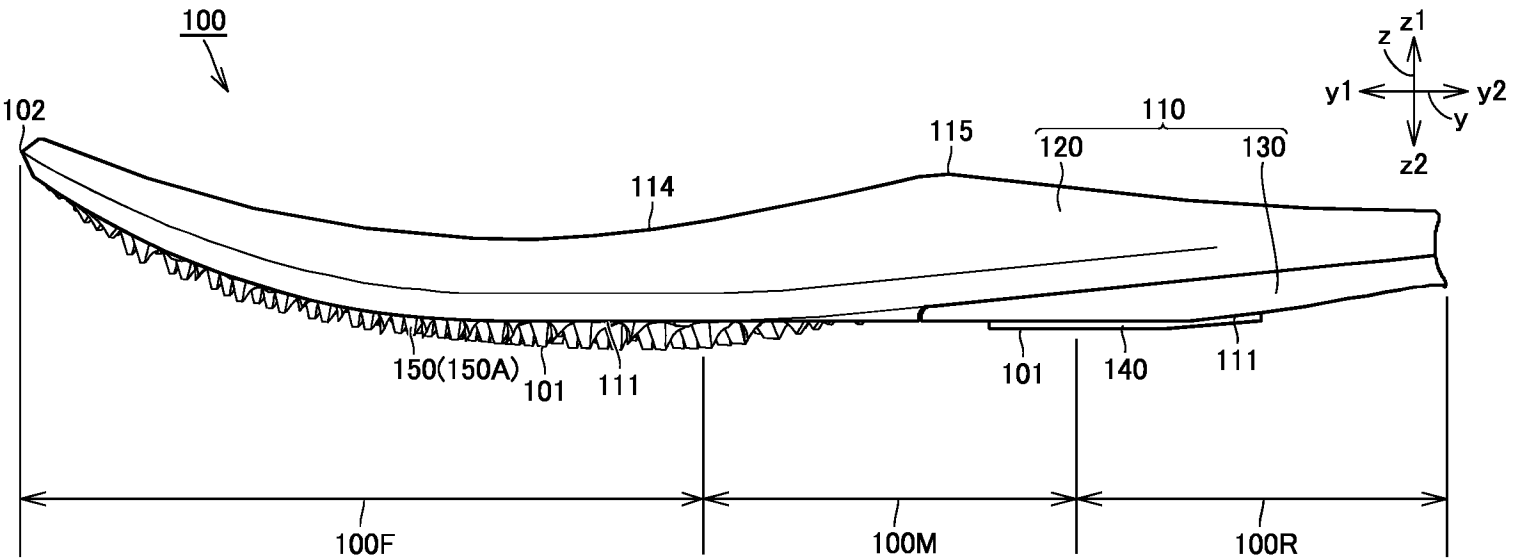
FIG. 3 is a side view of the shoe sole according to one embodiment of the present invention as viewed from a lateral foot side.
Figure 4:
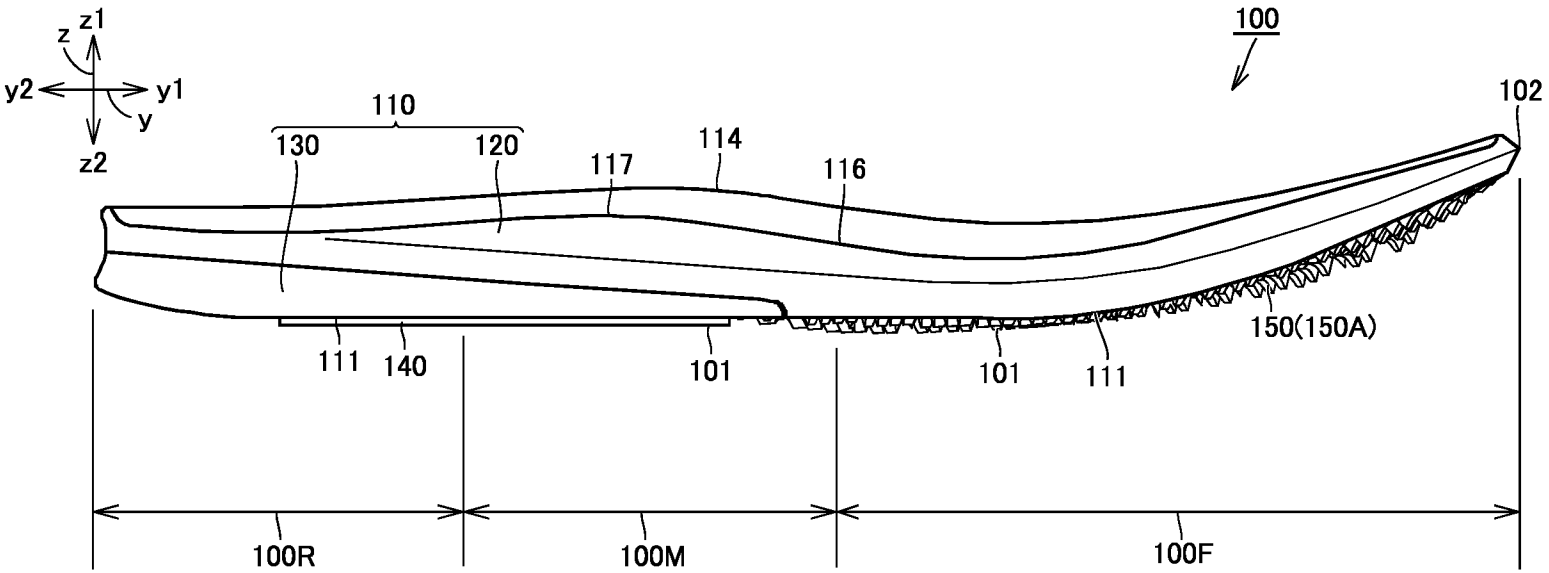
FIG. 4 is a side view of the shoe sole according to one embodiment of the present invention as viewed from a medial foot side.
Figure 5:
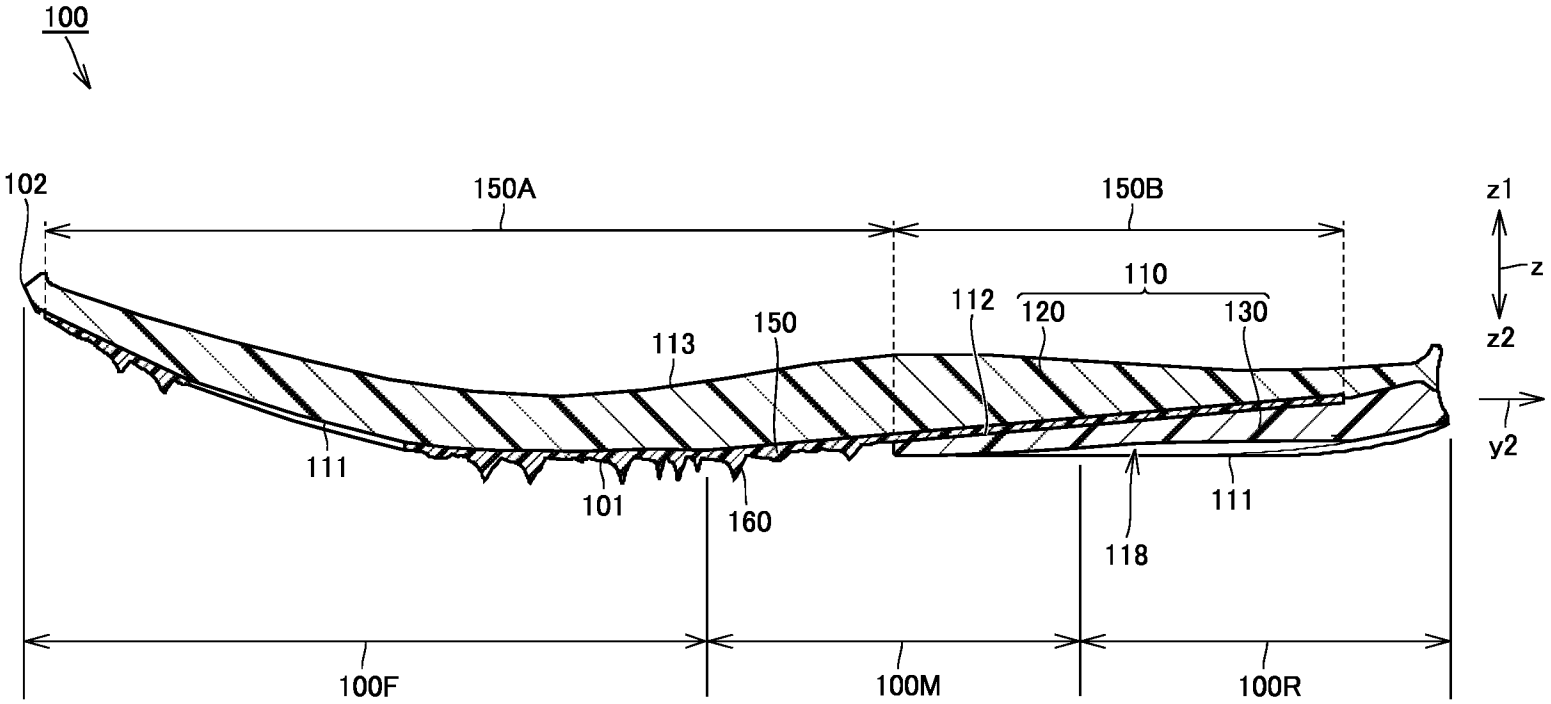
FIG. 5 is a cross-sectional view of the shoe sole in FIG. 2 as viewed in a direction of an arrow along a line V-V.

FIG. 2 is a bottom view showing a shoe sole according to one embodiment of the present invention as viewed from below. FIG. 3 is a side view of the shoe sole according to one embodiment of the present invention as viewed from a lateral foot side. FIG. 4 is a side view of the shoe sole according to one embodiment of the present invention as viewed from a medial foot side. FIG. 5 is a cross-sectional view of the shoe sole in FIG. 2 as viewed in a direction of an arrow along a line V-V.

As shown in FIGS. 2 to 5, the shoe sole 100 according to the first embodiment of the present invention includes: a front foot portion 100F that supports a toe portion and a ball portion of a foot of a wearer; a middle foot portion 100M that supports an arch portion of the foot of the wearer; and a rear foot portion 100R that supports a heel portion of the foot of the wearer. The front foot portion 100, the middle foot portion 100M, and the rear foot portion 100R are connected in a front-rear direction y. For example, the dimension of the front foot portion 100F in the front-rear direction y is approximately 40% or more and 60% or less of the dimension of the shoe sole 100 in the front-rear direction y, the dimension of the middle foot portion 100M in the front-rear direction y is approximately 20% or more and 30% or less of the dimension of the shoe sole 100 in the front-rear direction y, and the dimension of the rear foot portion 100R in the front-rear direction y is approximately 20% or more and 30% or less of the dimension of the shoe sole 100 in the front-rear direction y. The accompanying drawings illustrating the present embodiment each show the shoe sole 100 configured such that, with respect to the front-rear direction y of the shoe sole 100, the dimension of the front foot portion 100F in the front-rear direction y is 50%, the dimension of the middle foot portion 100M in the front-rear direction y is 25%, and the dimension of the rear foot portion 100R in the front-rear direction y is 25%.

The shoe sole 100 includes a sole body portion 110, an outsole 140, and a plate portion 150. The shoe sole 100 may further include an insole located upward z1 of the sole body portion 110 and connected to the upper 10. The shoe sole 100 may include a sockliner located at the uppermost position of the shoe sole 100 and being in direct contact with the wearer's sole.

The sole body portion 110 is made of a foaming or non-foaming component of synthetic resin or rubber. The sole body portion 110 is made of, for example, a foaming component of ethylene-vinyl acetate copolymer (EVA), a foaming component of thermoplastic polyurethane, a foaming component of thermoplastic polyamide elastomer, a foaming component of thermoplastic polyester elastomer, a foaming component of butadiene rubber, or the like. Thereby, the sole body portion 110 is relatively lightweight and reversibly deformable in accordance with flexural deformation of the foot of the wearer of the shoe 1. In other words, the sole body portion 110 can be formed of a material generally called a midsole material. The sole body portion 110 may further include a gel-like shock absorbing member.

The sole body portion 110 is located to continuously extend from the front foot portion 100F to the rear foot portion 100R. More specifically, the sole body portion 110 is located to extend from the front end to the rear end of the shoe sole 100.

As shown in FIG. 5, in the front foot portion 100F, a lower surface 111 of the sole body portion 110 is inclined upward as the lower surface 111 extends forward y1 and curved in the shape protruding downward z2. The middle foot portion 100M is provided with a hole portion 112 extending rearward y2 from the lower surface 111 of the sole body portion 110. In the present embodiment, the hole portion 112 is located in the middle foot portion 100M and the rear foot portion 100R. The hole portion 112 may be formed to extend rearward from the lower surface 111 of the sole body portion 110 in the front foot portion 100F or from the lower surface 111 of the sole body portion 110 in the rear foot portion 100R. In other words, the hole portion 112 may be located in the front foot portion 100F or may be located only in the rear foot portion 100R. The hole portion 112 is formed so as to be inclined upward as the hole portion 112 extends rearward.

Further, the rear end portion of the lower surface 111 of the sole body portion 110 is inclined upward z1 as the rear end portion extends rearward y2. This suppresses such a situation that the wearer's foot contacting the ground is obstructed by the rear end portion of the sole body portion 110. Thereby, the wearer's foot can smoothly come into contact with the ground.

Figure 6:
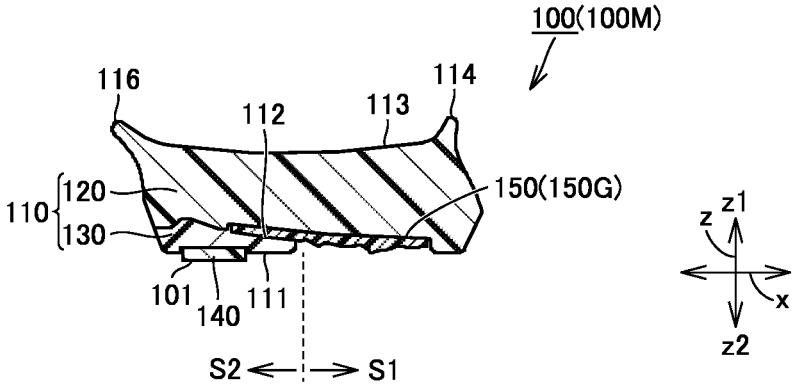
FIG. 6 is a cross-sectional view of the shoe sole in FIG. 2 as viewed in a direction of an arrow along a line VI-VI.
Figure 7:
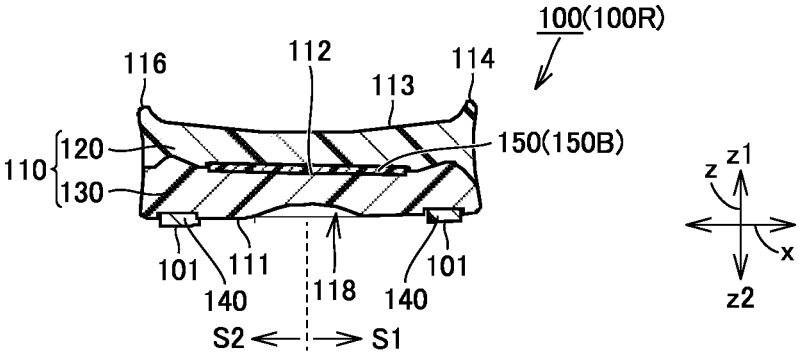
FIG. 7 is a diagram of the shoe sole in FIG. 2 as viewed in a direction of an arrow along a line VII-VII.

FIG. 6 is a cross-sectional view of the shoe sole in FIG. 2 as viewed in a direction of an arrow along a line VI-VI. FIG. 7 is a diagram of the shoe sole in FIG. 2 as viewed in a direction of an arrow along a line VII-VII. As shown in FIGS. 6 and 7, an upper surface 113 of the sole body portion 110 is curved in a recessed shape when viewed in the front-rear direction y.

As shown in FIGS. 3, 6 and 7, a lateral foot side upper end portion 114 that is an end portion of the upper surface 113 on a lateral foot side S1 of the shoe sole 100 extends in the front-rear direction y. In the middle foot portion 100M, the lateral foot side upper end portion 114 is curved in the shape protruding upward z1 when viewed in a foot width direction x. In the middle foot portion 100M, a lateral foot side top portion 115 that is located most upward z1 in the lateral foot side upper end portion 114 is located rearward y2 of the center of the middle foot portion 100M in the front-rear direction y. This improves the performance to support the wearer's foot after the foot comes into contact with the ground.

As shown in FIGS. 4, 6, and 7, a medial foot side upper end portion 116 that is an end portion of the upper surface 113 on a medial foot side S2 of the shoe sole 100 extends in the front-rear direction y. In the middle foot portion 100M, the medial foot side upper end portion 116 is curved in the shape protruding upward z1 when viewed in the foot width direction. In the middle foot portion 100M, a medial foot side top portion 117 that is located most upward in the medial foot side upper end portion 116 is located substantially at the center of the middle foot portion 100M in the front-rear direction y. This can suppress pronation occurring when the center of gravity of the load from the wearer's foot shifts.

As shown in FIGS. 2 and 7, a recess 118 is provided in the lower surface 111 of the sole body portion 110. This improves the shock absorbing performance of the sole body portion 110. The recess 118 is located at the center of the shoe sole 100 in the foot width direction x so as to extend in the front-rear direction y. The recess 118 is located downward z2 of the hole portion 112.

As shown in FIGS. 2 to 7, the sole body portion 110 includes a first body portion 120 and a second body portion 130. The first body portion 120 is located above the second body portion 130. The first body portion 120 forms the entirety of the upper surface 113 of the sole body portion 110. The second body portion 130 is connected to the first body portion 120 at a portion on the lateral foot side S1 and a portion on the medial foot side S2 as viewed from the hole portion 112, and also at a portion on the rear side of the shoe sole 100 as viewed from the hole portion 112. In other words, the first body portion 120 and the second body portion 130 are spaced apart from each other in the up-down direction z, so that the hole portion 112 is provided. The recess 118 is provided in the lower surface 111, specifically, in the lower surface of the second body portion 130.

In the present embodiment, the first body portion 120 and the second body portion 130 are separately molded components, and are joined to each other at a connecting portion between the first body portion 120 and the second body portion 130. The first body portion 120 and the second body portion 130 are made of the same material. The first body portion 120 and the second body portion 130 may be made of different materials. Further, the sole body portion 110 may be formed of a single molded body.

The outsole 140 is made of a material that is higher in Young's modulus and higher in hardness than the sole body portion 110. The outsole 140 is made of, for example, a foaming or non-foaming component of rubber, or a foaming or non-foaming component of synthetic resin such as polyurethane. In the present embodiment, since the proportion of the outsole 140 in the entire shoe sole 100 is relatively small, the outsole 140 may be made of a non-foaming synthetic resin.

The outsole 140 forms a part of a ground contact surface 101 of the shoe sole 100. The outsole 140 is located on the lower surface 111 of the sole body portion 110. More specifically, the outsole 140 is located on the lower surface 111 in the second body portion 130. When viewed in the up-down direction z, the outsole 140 is located on each of the lateral foot side and the medial foot side of the shoe sole 100 with respect to the hole portion 112. In other words, since the outsoles 140 are separately located on the lateral foot side S1 and the medial foot side S2 of the shoe sole 100, the shoe sole 100 can be improved in durability and reduced in weight. The outsole 140 is not provided in the recess 118.

On the ground contact surface 101 side, the outsole 140 may be provided with a tread pattern for improving the grip performance or may be provided with a plurality of protruding portions protruding downward.

The plate portion 150 is formed of a material that is higher in rigidity than the material of the sole body portion 110. The plate portion 150 is made of fiber reinforced plastic (FRP), for example. In the present embodiment, the plate portion 150 is formed of carbon fiber reinforced plastic (CFRP). Reinforcing fibers are provided entirely inside the plate portion 150 formed of CFRP. The plate portion 150 formed of CFRP is formed, for example, by hot press molding, and more specifically, what is called a heat and cool method.

As shown in FIGS. 2 and 5, the plate portion 150 extends at least in the front foot portion 100F in the front-rear direction y. More specifically, the plate portion 150 is located continuously to extend from the front foot portion 100F to the rear foot portion 100R.

The plate portion 150 is joined to the sole body portion 110. The plate portion 150 is inserted into the hole portion 112 of the sole body portion 110. The hole portion 112 is filled with the plate portion 150. In the present embodiment, in the front foot portion 100F, the sole body portion 110 is located on the lower surface 111 of the sole body portion 110 (the first body portion 120). The plate portion 150 is located inside the hole portion 112 in the rear foot portion 100R, and more specifically, located between the first body portion 120 and the second body portion 130. In other words, the plate portion 150 is located on the lower surface of the first body portion 120 in the front foot portion 100F, the middle foot portion 100M, and the rear foot portion 100R.

Since the plate portion 150 is inserted into the hole portion 112 as described above, the plate portion 150 has an exposed region 150A and an accommodated region 150B. The exposed region 150A forms the ground contact surface 101 of the shoe sole 100 at least in the front foot portion 100F. The exposed region 150A is located to continuously extend from the front foot portion 100F to at least a part of the middle foot portion 100M. The accommodated region 150B is accommodated inside (the hole portion 112 of) the sole body portion 110 at least in the rear foot portion 100R. In other words, the exposed region 150A is a region other than the accommodated region 150B in the plate portion 150.

In the present embodiment, a rear end 150AE of the exposed region 150A is located at a portion that supports the lateral foot side of the foot of the wearer (on the lateral foot side S1 of the shoe sole 100). Thus, as shown in FIGS. 2, 5 and 6, a portion in the vicinity of the rear end 150AE of the exposed region 150A is inclined upward z1 from the lateral foot side S1 toward the medial foot side S2 of the shoe sole 100, when viewed in the front-rear direction y. Also, as shown in FIGS. 2 and 6, in the up-down direction z, the rear end 150AE of the exposed region 150A is curved in the shape protruding downward z2.

As viewed in the up-down direction z, the dimension from the tip end 102 of the shoe sole 100 to the rear end 150AE of the exposed region 150A in the front-rear direction y may be 20% or more, 40% or more, or 60% or more, or may be 80% or less, or 75% or less of the dimension of the shoe sole 100 in the front-rear direction y, but is preferably 20% or more and 70% or less of the dimension of the shoe sole 100 in the front-rear direction y. In the present embodiment, the dimension from the tip end 102 of the shoe sole 100 to the rear end 150AE of the exposed region 150A is approximately 65% of the dimension of the shoe sole 100 in the front-rear direction y. The exposed region 150A may be located in a partial portion or the entire portion of the plate portion 150 that is located in the front foot portion 100F. Further, the accommodated region 150B may be located in a partial portion or the entire portion of the plate portion 150 that is located in the rear foot portion 100R.

As shown in FIG. 5, in the present embodiment, in at least a part of the middle foot portion 100M and at least a part of the rear foot portion 100R, the plate portion 150 is inclined upward z1 as it extends rearward y2. From the front end to the rear end of the middle foot portion 100M, the plate portion 150 is inclined upward z1 as it extends rearward y2. From the front end to the rear end of the rear foot portion 100R, the plate portion 150 is inclined upward z1 as it extends rearward y2. Entirely in the accommodated region 150B, the plate portion 150 is inclined upward z1 as it extends rearward y2. In the rear foot portion 100R, the plate portion 150 may extend orthogonal to the up-down direction z when viewed in the foot width direction x.

Further, as shown in FIG. 2, in the middle foot portion 100M, the plate portion 150 has a narrow region 150G in which the side edge on the medial foot side S2 is curved in the shape recessed toward the center in the foot width direction x. As shown in FIG. 6, in the narrow region 150G, the plate portion 150 is curved in the shape protruding downward. In the narrow region 150G, the plate portion 150 may have a flat shape. In the narrow region 150G, the plate portion 150 is inclined relative to the foot width direction x when viewed in the front-rear direction y.

As shown in FIG. 2, the plate portion 150 includes a lateral foot side region 150C, a medial foot side region 150D, a rear side region 150E, and a tip end region 150F.

The lateral foot side region 150C extends in the front-rear direction y and supports the lateral foot side of the wearer's foot. In the present embodiment, the lateral foot side region 150C is located in the front foot portion 100F, but may be located further in the middle foot portion 100M or may also be located in the rear foot portion 100R.

The medial foot side region 150D extends in the front-rear direction y and supports the medial foot side of the wearer's foot. In the front foot portion 100F, at least a part of the medial foot side region 150D is spaced apart from the lateral foot side region 150C in the foot width direction x. In the present embodiment, the medial foot side region 150D is located in the front foot portion 100F and the middle foot portion 100M, but may be located only in the front foot portion 100F or may be located in the rear foot portion 100R. The medial foot side region 150D may not be spaced apart from the lateral foot side region 150C.

The rear side region 150E is located at least in the rear end portion of the plate portion 150, and connects the lateral foot side region 150C and the medial foot side region 150D. In the present embodiment, the rear side region 150E is located in the front foot portion 100F, the middle foot portion 100M, and the rear foot portion 100R, but may be located only in the front foot portion 100F, may be located only in the middle foot portion 100M and the rear foot portion 100R, or may be located only in the rear foot portion 100R.

The tip end region 150F connects the front end of the lateral foot side region 150C and the front end of the medial foot side region 150D that are spaced apart from each other. The tip end region 150F is located in a portion of the shoe sole 100 that supports the toe of the wearer.

The plate portion 150 has at least one beam portion 151 spaced apart from both the tip end region 150F and the rear side region 150E, extending in the foot width direction x, and connecting the lateral foot side region 150C and the medial foot side region 150D that are spaced apart from each other. In the present embodiment, the plate portion 150 has only one beam portion 151. The beam portion 151 is located closer to the rear side region 150E than to the tip end region 150F. Further, the beam portion 151 is located in a portion of the shoe sole 100 that supports an MP joint of the wearer's foot (a portion indicated by a long dashed short dashed line MP). This allows the wearer to effectively apply force to the ground when the wearer's foot kicks the ground.

The plate portion 150 may be formed to have a thickness that varies in the front-rear direction y. The plate portion 150 having a thickness that varies in the front-rear direction y allows the plate portion 150 to have rigidity that varies in each region of the plate portion 150.

Figure 8:
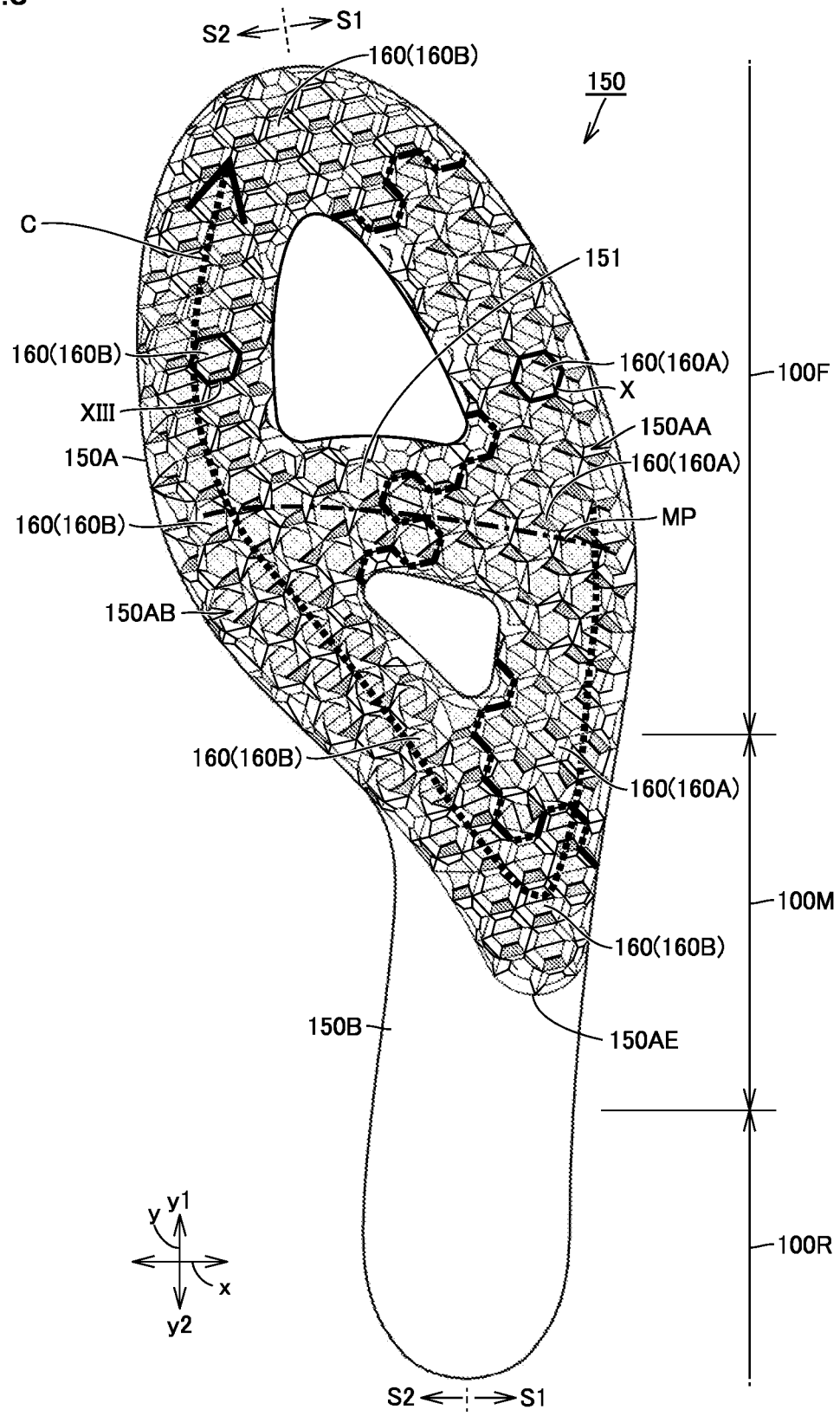
FIG. 8 is a bottom view of a plate portion according to one embodiment of the present invention as viewed from below.
Figure 9:
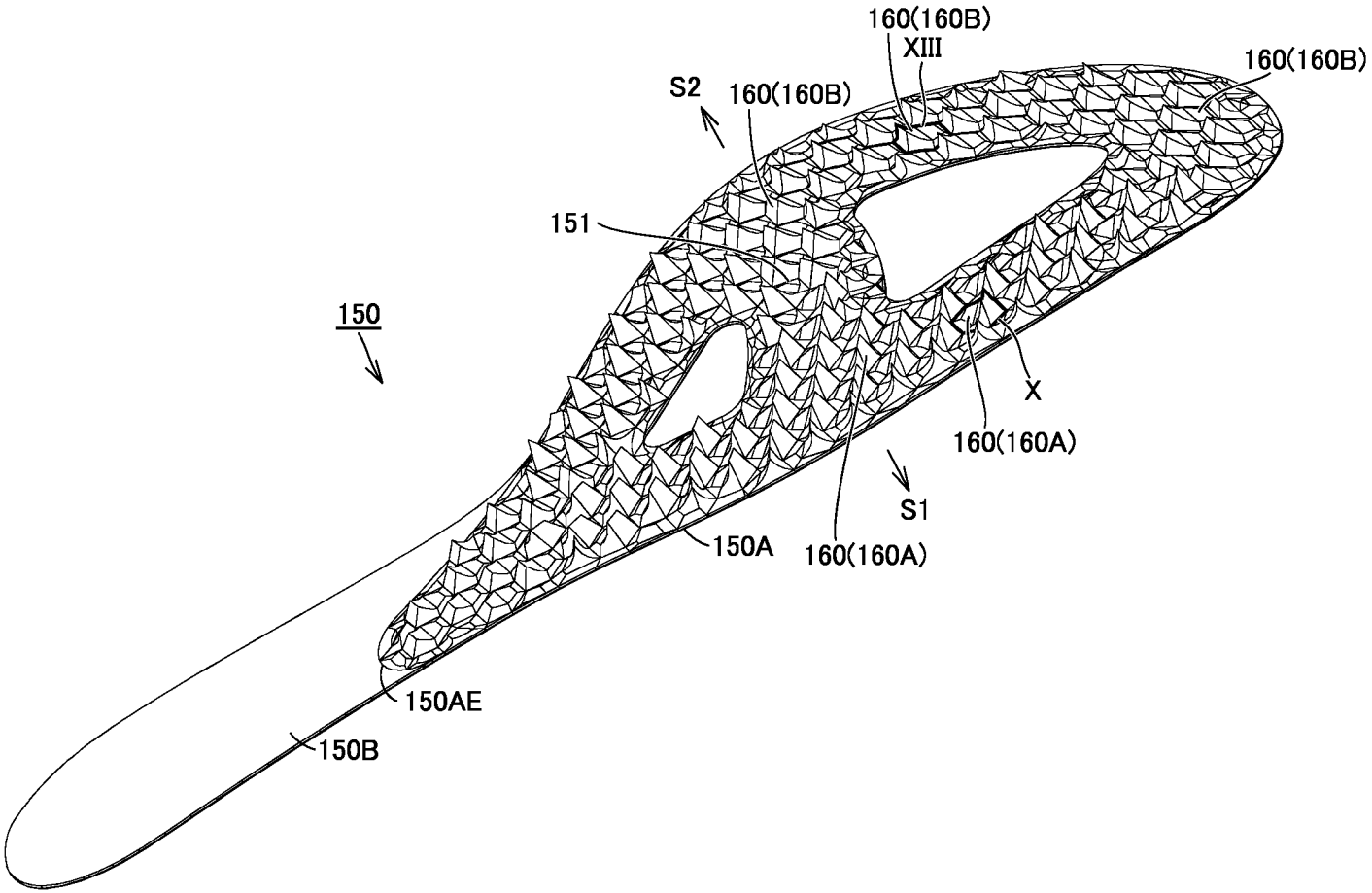
FIG. 9 is a perspective view of the plate portion according to one embodiment of the present invention as viewed from below.

FIG. 8 is a bottom view of a plate portion according to one embodiment of the present invention as viewed from below. FIG. 9 is a perspective view of the plate portion according to one embodiment of the present invention as viewed from below. As shown in FIGS. 8 and 9, in the exposed region 150A, the plate portion 150 has a plurality of protrusions 160 protruding downward. Thus, when the plate portion 150 comes into contact with the ground, the protrusions 160 penetrate into the ground like spikes, thereby increasing the grip force of the shoe sole 100 against the ground. In the present embodiment, the plurality of protrusions 160 are located substantially entirely over the exposed region 150A.

Figure 10:
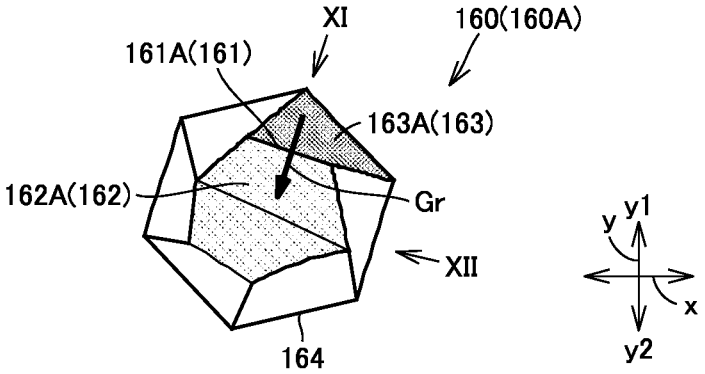
FIG. 10 is a bottom view of a protrusion located in an X region of the plate portion shown in FIGS. 8 and 9, as viewed from below.
Figure 11:
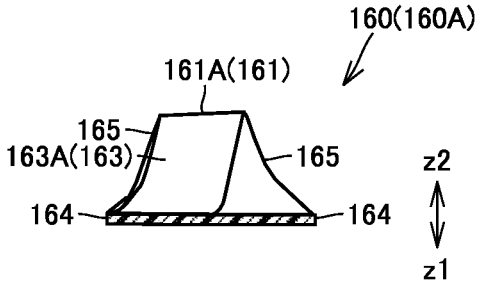
FIG. 11 is a diagram of the protrusion shown in FIG. 10 as viewed in a direction of an arrow XI.
Figure 12:
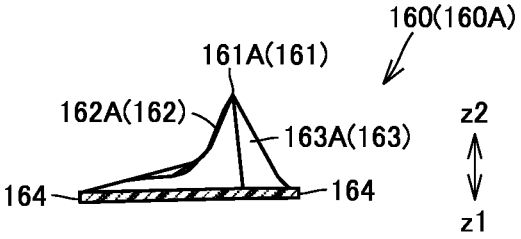
FIG. 12 is a diagram of the protrusion shown in FIG. 11 as viewed in a direction of an arrow XII.

FIG. 10 is a bottom view of a protrusion located in an X region of the plate portion shown in FIGS. 8 and 9, as viewed from below. FIG. 11 is a diagram of the protrusion shown in FIG. 10 as viewed in a direction of an arrow XI. FIG. 12 is a diagram of the protrusion shown in FIG. 11 as viewed in a direction of an arrow XII. As shown in FIGS. 10 to 12, the protrusion 160 has: an inclined surface 162 that is located on one side of a tip end 161 of the protrusion 160 as viewed from below; and a steeply inclined surface 163 that is located on the other side of the tip end 161 as viewed from below. The steeply inclined surface 163 is steeper than the inclined surface 162. In FIGS. 8 and 10, some of the inclined surfaces 162 are represented by a portion filled with smaller dots, and some of the steeply inclined surfaces 163 are represented by a portion filled with larger dots. Also in other figures, a portion filled with smaller dots in the protrusion 160 shows some of the inclined surfaces 162, and a portion filled with larger dots in the protrusion 160 shows the steeply inclined surface 163. In the state where the tip end 161 of the protrusion 160 penetrates into the ground when the wearer's foot hits or kicks the ground, the frictional force from the ground particularly significantly acts from the steeply inclined surface 163 side to the inclined surface 162 side, as viewed from below. The direction in which such significant frictional force acts may also be referred to as a "grip direction (Gr)" of the protrusion 160. In FIG. 10 and other figures, the grip direction Gr may be indicated by an arrow.

In the present embodiment, the tip end 161 of the protrusion 160 has a linear outer shape as viewed from below. Thus, the grip direction Gr of the protrusion 160 shown in FIG. 10 is oriented in one direction so as to be substantially orthogonal to the tip end 161 as viewed from below.

The protrusion 160 further has a peripheral edge 164 defining the outer shape of the protrusion 160 when viewed from below. The peripheral edge 164 is a portion of the protrusion 160 where the plate portion 150 has the smallest thickness. The outer shape of the peripheral edge 164 as viewed from below is not particularly limited, but is hexagonal in the present embodiment. Thus, the plurality of protrusions 160 are most densely laid in the exposed region 150A. The peripheral edge 164 may have a curved outer shape such as a circular shape as viewed from below.

As shown in FIGS. 10 and 11, when viewed in the direction extending in the grip direction Gr of the protrusion 160, a side inclined surface 165 extending downward z2 from the tip end 161 may be connected to the peripheral edge 164. This increases the width of the protrusion 160 to increase the grip force of the protrusion 160 against the ground, and also, improves the moldability. As shown in FIG. 11, the side inclined surface 165 may be curved in a recessed shape.

Further, as shown in FIGS. 10 and 12, when viewed in the direction orthogonal to the grip direction Gr of the protrusion 160, the inclined surface 162 may be connected to the peripheral edge 164, and the steeply inclined surface 163 may be connected to the peripheral edge 164. This increases the length of the protrusion 160 in the grip direction Gr, thereby increasing the grip force of the protrusion 160 against the ground. Further, as shown in FIG. 12, the inclined surface 162 may be curved in a recessed shape when viewed in the direction orthogonal to both the up-down direction z and the grip direction Gr, and the steeply inclined surface 163 may be curved in a recessed shape when viewed in the direction orthogonal to both the up-down direction z and the grip direction Gr.

As shown in FIG. 8, the exposed region 150A includes a first exposed region 150AA and a second exposed region 150AB. In FIG. 8, a thick long dashed double-short dashed line indicates the boundary between the first exposed region 150AA and the second exposed region 150AB.

The first exposed region 150AA is located in at least a part of a portion of the shoe sole 100 that supports the lateral foot side of the foot of the wearer, and a plurality of protrusions 160 are disposed in the first exposed region 150AA. More specifically, the plurality of protrusions 160 located in the first exposed region 150AA include a plurality of first protrusions 160A. In other words, in the present embodiment, the plurality of first protrusions 160A are disposed at least on the lateral foot side S1 of the shoe sole 100.

The protrusion 160 shown in FIGS. 10 to 12 is a first protrusion 160A. The first protrusion 160A has a first inclined surface 162A as the inclined surface 162, and a first steeply inclined surface 163A as the steeply inclined surface 163. The first inclined surface 162A is located rearward of a tip end 161A of the first protrusion 160A when viewed from below. The first steeply inclined surface 163A is steeper than the first inclined surface 162A, and located forward of the tip end 161A of the first protrusion 160A when viewed from below. In other words, in the first protrusion 160A, the grip direction Gr is oriented rearward when viewed in the foot width direction x. Thereby, when the wearer's foot starts to come into contact with the ground with the first exposed region 150AA on which first protrusions 160A are disposed, a large frictional force acts on the movement of the shoe sole 100 that is to slide forward y1 against the ground. This effect may be hereinafter simply referred to as a "braking effect". This braking effect increases the grip force of the shoe sole 100 against the ground at the time when the shoe sole 100 contacts the ground, with the result that the running performance achieved by the shoe sole 100 is enhanced.

The plurality of first protrusions 160A may have different shapes as long as the grip direction Gr is oriented rearward y2 when viewed in the foot width direction x.

As shown in FIG. 8, the second exposed region 150AB is located in at least a part of a portion of the shoe sole 100 that supports the medial foot side of the foot of the wearer. A plurality of protrusions 160 different in shape from the plurality of protrusions 160 disposed in the first exposed region 150AA are disposed. The term "different in shape" of the protrusions 160 also means that the protrusions 160 are different in shape such that the protrusions 160 are different in grip direction Gr.

Specifically, the plurality of protrusions 160 located in the second exposed region 150AB include a plurality of second protrusions 160B. In other words, in the present embodiment, the plurality of second protrusions 160B are disposed at least on the medial foot side S2 of the shoe sole 100.

Figure 13:
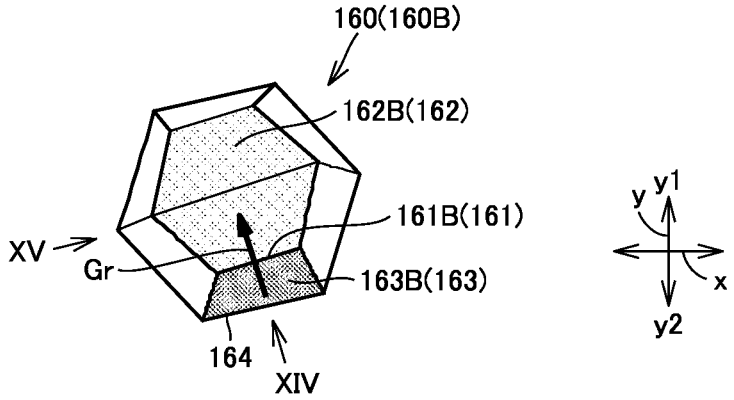
FIG. 13 is a bottom view of a protrusion located in an XIII region of the plate portion shown in FIGS. 8 and 9, as viewed from below.
Figure 14:
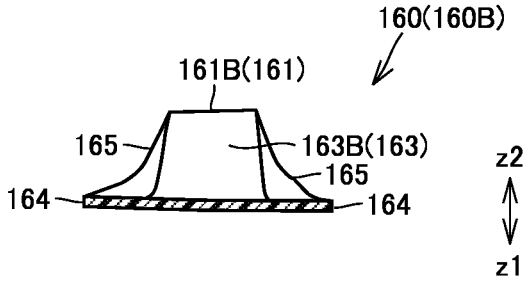
FIG. 14 is a diagram of the protrusion shown in FIG. 13 as viewed in a direction of an arrow XIV.
Figure 15:
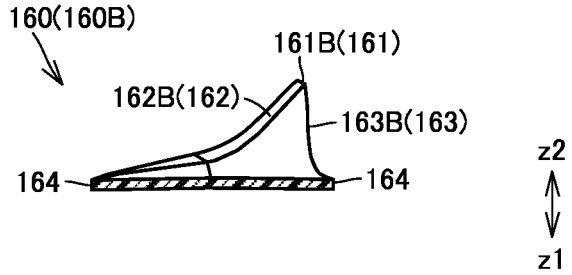
FIG. 15 is a diagram of the protrusion shown in FIG. 13 as viewed in a direction of an arrow XV.

FIG. 13 is a bottom view of a protrusion located in an XIII region of the plate portion shown in FIGS. 8 and 9, as viewed from below. FIG. 14 is a diagram of the protrusion shown in FIG. 13 as viewed in a direction of an arrow XIV. FIG. 15 is a diagram of the protrusion shown in FIG. 13 as viewed in a direction of an arrow XV. The protrusion 160 shown in FIGS. 13 to 15 is the second protrusion 160B.

The second protrusion 160B has a second inclined surface 162B as the inclined surface 162, and a second steeply inclined surface 163B as the steeply inclined surface 163. The second inclined surface 162B is located forward of a tip end 161B of the second protrusion 160B when viewed from below. The second steeply inclined surface 163B is steeper than the second inclined surface 162B, and is located rearward of the tip end 161B of the second protrusion 160B when viewed from below. In other words, in the second protrusion 160B, the grip direction Gr is oriented forward y1 when viewed in the foot width direction x. Thereby, when the wearer's foot is about to kick the ground with the second exposed region 150AB on which the second protrusions 160B are disposed, frictional force significantly acts on the movement of the shoe sole 100 that is to slide rearward y2 against the ground. This effect may be hereinafter simply referred to as an "acceleration effect". This acceleration effect increases the grip force of the shoe sole 100 against the ground when the shoe sole 100 kicks the ground, with the result that the running performance achieved by the shoe sole 100 is enhanced.

The plurality of second protrusions 160B may have different shapes as long as the grip direction Gr is oriented rearward y2 when viewed in the foot width direction x.

As shown in FIG. 8, in the region of the exposed region 150A that supports the MP joint of the wearer, the first exposed region 150AA is located in a portion that supports the lateral foot side of the foot of the wearer, and the second exposed region 150AB is located in a portion that supports the medial foot side of the foot of the wearer. More specifically, in the region that supports the MP joint, at least the first protrusions 160A are located on the lateral foot side S1 of the shoe sole 100, and at least the second protrusions 160B are located on the medial foot side S2 of the shoe sole 100. In FIG. 8, a portion that supports the MP joint is indicated by a long dashed short dashed line MP.

The second exposed region 150AB is located in a region of the exposed region 150A that is located in the front end portion of the plate portion 150 (a region that supports at least the wearer's toe). More specifically, the second protrusions 160B are located in a region of the plate portion 150 that supports at least the wearer's toe. Further, as shown in FIG. 9, the plurality of second protrusions 160B located in the region of the plate portion 150 that supports at least the wearer's toe include protrusions that are lower in height than the protrusions 160 located in the portion that supports the MP joint. Thereby, the rigidity of the plate portion 150 is relatively high in the portion that supports the MP joint and relatively low in the front end portion of the plate portion 150.

In a portion of the exposed region 150A that is located on the front side in the middle foot portion 100M, the first exposed region 150AA is located on the lateral foot side and the second exposed region 150AB is located on the medial foot side. More specifically, in a portion of the exposed region 150A that is located on the front side in the middle foot portion 100M, the first protrusions 160A are located on the lateral foot side S1 of the shoe sole 100, and the second protrusions 160B are located on the medial foot side of the shoe sole 100. The second exposed region 150AB is located in a portion of the exposed region 150A that is located on the rear side in the middle foot portion 100M. More specifically, the second protrusions 160B are located in a portion of the exposed region 150A that is located on the rear side in the middle foot portion 100M.

In FIG. 8, a dotted line C schematically shows the shift of the center of gravity of the load applied to the plate portion 150 from the wearer's foot during running of the wearer of the shoes 1 having the shoe soles 100. As shown in FIG. 8, when a load starts to be applied from the wearer's foot during running, i.e., when the wearer's foot starts to come into contact with the ground with the plate portion 150, the braking effect of the first protrusions 160A in the first exposed region 150AA improves the grip force against the ground. After the wearer's foot contacts the ground, the center of gravity shifts from the first exposed region 150AA to the second exposed region 150AB. When the load from the wearer's foot starts to decrease during running, i.e., when the wearer's foot starts to kick the ground with the plate portion 150, the acceleration effect of the second protrusions 160B in the second exposed region 150AB improves the grip force against the ground. Thus, in the shoe sole 100 according to the present embodiment, the braking effect and the acceleration effect as described above can increase the thrust force while the wearer of the shoes is running.

As described above, the shoe sole 100 according to the first embodiment of the present invention includes: the front foot portion 100F that supports a toe portion and a ball portion of a foot of a wearer; the middle foot portion 100M that supports an arch portion of the foot of the wearer; and the rear foot portion 100R that supports a heel portion of the foot of the wearer, in which the front foot portion 100F, the middle foot portion 100M, and the rear foot portion 100R are connected in the front-rear direction y. The shoe sole 100 includes the sole body portion 110 and the plate portion 150. The sole body portion 110 is located to continuously extend from the front foot portion 100F to the rear foot portion 100R. The plate portion 150 is located to continuously extend from the front foot portion 100F to the rear foot portion 100R, joined to the sole body portion 110, and formed of a material that is higher in rigidity than a material forming the sole body portion 110. The plate portion 150 has the exposed region 150A and the accommodated region 150B. The exposed region 150A forms the ground contact surface 101 of the shoe sole 100 at least in the front foot portion 100F. The accommodated region 150B is accommodated inside the sole body portion 110 at least in the rear foot portion 100R. In at least a part of the middle foot portion 100M and at least a part of the rear foot portion 100R, the plate portion 150 is inclined upward z1 as the plate portion 150 extends rearward y2.

Thus, when the shoe sole 100 comes into contact with the ground while the wearer of the shoes 1 having the shoe soles 100 is running, the plate portion 150 receives a load downward from the wearer's foot. In this case, since the plate portion 150 has the exposed region 150A and the accommodated region 150B as described above and the plate portion 150 is inclined as described above, the portion of the plate portion 150 that is located in the middle foot portion 100M and the rear foot portion 100R is flexed and deformed by the load so as to significantly sink downward. Since the plate portion 150 has relatively high rigidity, the plate portion 150 that has sunk as described above then tends to return to its original shape. At this time, in the middle foot portion 100M and the rear foot portion 100R, the plate portion 150 applies upward force from below to the wearer's foot located on the plate portion 150. The above-mentioned flexural deformation and the force caused thereby, i.e., the repulsive force of the plate portion 150, allow the heel portion of the wearer to significantly bounce upward when the shoe sole 100 kicks the ground. In this way, the running performance by the shoes 1 can be improved.

In the present embodiment, from a front end to a rear end of the middle foot portion 100M, the plate portion 150 is inclined upward z1 as the plate portion 150 extends rearward y2.

This increases, upon coming into contact with the ground, the amount of displacement of the plate portion 150 in the up-down direction z in the middle foot portion 100M and the rear foot portion 100R when viewed from the front end of the middle foot portion 100M, thereby allowing further improvement in the effect of causing the heel portion of the wearer's foot to bounce up by the repulsive force of the plate portion 150.

In the present embodiment, from a front end to a rear end of the rear foot portion 100R, the plate portion 150 is inclined upward z1 as the plate portion 150 extends rearward y2.

This increases, upon coming into contact with the ground, the amount of displacement of the plate portion 150 in the up-down direction z in the rear foot portion 100R when viewed from the front end of the rear foot portion 100R, thereby allowing further improvement in the effect of causing the heel portion of the wearer's foot to bounce up by the repulsive force of the plate portion 150.

In the present embodiment, in the plate portion 150, the accommodated region 150B is entirely inclined upward z1 as the accommodated region 150B extends rearward y2.

This increases, upon coming into contact with the ground, the amount of displacement of the plate portion 150 in the up-down direction z in the accommodated region 150B when viewed from the exposed region 150A, thereby allowing further improvement in the effect of causing the heel portion of the wearer's foot to bounce up by the repulsive force of the plate portion 150.

In the shoe sole 100 according to the first embodiment of the present invention, the plate portion 150 extends in the front-rear direction y at least in the front foot portion 100F, is joined to the sole body portion 110, and is formed of a material that is higher in rigidity than a material forming the sole body portion 110. The plate portion 150 includes a lateral foot side region 150C, a medial foot side region 150D, and a rear side region 150E. The lateral foot side region 150C extends in the front-rear direction y and supports a lateral foot side of the foot of the wearer. The medial foot side region 150D extends in the front-rear direction y and supports a medial foot side of the foot of the wearer. At least a part of the medial foot side region 150D in the front foot portion 100F is spaced apart from the lateral foot side region 150C in a foot width direction x. The rear side region 150E is located at least in a rear end portion of the plate portion 150 and connects the lateral foot side region 150C and the medial foot side region 150D.

Thereby, the rigidity of the plate portion 150 is relatively high in the rear side region 150E, and relatively low in the lateral foot side region 150C and the medial foot side region 150D that are spaced apart from each other. While the wearer wearing the shoes 1 having the shoe soles 100 is running, the kicking action of the wearer is supported by the repulsive force of the plate portion 150 in the rear side region 150E, and also, obstruction of flexing motion of the wearer's foot that is kicking the ground can be suppressed in the lateral foot side region 150C and the medial foot side region 150D. Thereby, the load applied to the feet can be reduced. In this way, the running performance by the shoes 1 can be improved.

In the present embodiment, the plate portion 150 further includes a tip end region 150F that connects a front end of the lateral foot side region 150C and a front end of the medial foot side region 150D, in which the lateral foot side region 150C and the medial foot side region 150D are spaced apart from each other.

Thereby, the rigidity of the plate portion 150 is relatively high in the tip end region 150F. Thus, the force from the wearer's toe is readily transmitted to the ground through the tip end region 150F of the plate portion 150 at the time when the wearer's foot kicks the ground.

Further, in the present embodiment, the plate portion 150 has at least one beam portion 151 spaced apart from both the tip end region 150F and the rear side region 150E, extending in the foot width direction x, and connecting the lateral foot side region 150C and the medial foot side region 150D that are spaced apart from each other.

Thus, the lateral foot side region 150C and the medial foot side region 150D are spaced apart from each other, so that the rigidity in the front-rear direction can be reduced, and also, the rigidity can be partially increased in the beam portion 151. Accordingly, the distribution of the rigidity in the plate portion 150 can be appropriately adjusted in accordance with the manner as to how the wearer kicks the ground.

In the present embodiment, the plate portion 150 has only one beam portion 151. The beam portion 151 is located closer to the rear side region 150E than to the tip end region 150F.

Thus, the portion of the plate portion 150 that is located forward of the beam portion 151 is relatively lower in rigidity and more likely to be deformed than the portion of the plate portion 150 that is located rearward of the beam portion 151. This can suppress such a situation that the movement of the wearer's toe is obstructed by the plate portion 150.

In the present embodiment, the plate portion 150 includes, in the exposed region 150A, a plurality of protrusions 160 protruding downward. The exposed region 150A includes a first exposed region 150AA and a second exposed region 150AB. The first exposed region 150AA is located in at least a part of a portion of the shoe sole 100 that supports a lateral foot side of the foot of the wearer, and a plurality of protrusions 160 are disposed in the first exposed region 150AA. The second exposed region 150AB is located in at least a part of a portion of the shoe sole 100 that supports a medial foot side of the foot of the wearer, and a plurality of protrusions 160 different in shape from the protrusions 160 disposed in the first exposed region 150AA are disposed in the second exposed region 150AB.

Thereby, in a short time period during which the wearer who is running comes into contact with the ground with the shoe sole 10 and then kicks the ground, an adjustment can be appropriately made to the direction in which the grip force of the protrusions 160 increases with respect to the ground into which the protrusions 160 penetrate. Thus, the thrust force of the shoes 1 during running can be increased.

In the present embodiment, the plurality of protrusions 160 located in the first exposed region 150AA include a plurality of first protrusions 160A. Each of the first protrusions 160A has a first inclined surface 162A located rearward of a tip end 161A of a corresponding one of the first protrusions 160A, and a first steeply inclined surface 163A located forward of a tip end 161B of the corresponding one of the first protrusions 160A, the first steeply inclined surface 163A being steeper than the first inclined surface 162A. The plurality of protrusions 160 located in the second exposed region 150AB include a plurality of second protrusions 160B. Each of the second protrusions 160B has a second inclined surface 162B located forward of a tip end 161B of a corresponding one of the second protrusions 160B, and a second steeply inclined surface 163B located rearward of a tip end 161B of the corresponding one of the second protrusions 160B, the second steeply inclined surface 163B being steeper than the second inclined surface 162B.

Thereby, when the wearer's foot comes into contact with the ground firstly with its lateral foot side during running, the first steeply inclined surface 163A can increase the frictional force against the movement of the shoe sole 100 that is to slide forward y1 (braking effect). Further, when the wearer's foot kicks the ground with its medial foot side during running, the frictional force against the movement of the shoe sole 100 that is to slide rearward can be increased (acceleration effect). Consequently, while the wearer is running, the grip force against the ground can be increased, and thereby, the thrust force for the wearer of the shoes 1 can be improved.

Further, in the present embodiment, in a region of the exposed region 150A that supports an MP joint of the wearer, the first exposed region 150AA is located in a portion that supports the lateral foot side of the foot of the wearer, and the second exposed region 150AB is located in a portion that supports the medial foot side of the foot of the wearer.

Thus, even when the center of gravity of the load applied onto the ground contact surface side of the wearer's foot during running shifts along the MP joint, the braking effect can be enhanced on the lateral foot side S1 and the acceleration effect can be enhanced on the medial foot side S2.

In the present embodiment, the second exposed region 150AB is located in a region of the exposed region 150A that is located in a front end portion of the plate portion 150.

Thus, when the wearer kicks the ground lastly with his/her toe during running, the acceleration effect can be further enhanced by the second protrusions 160B in the second exposed region 150AB.

Further, in the present embodiment, the exposed region 150A is located to continuously extend from the front foot portion 100F to at least a part of the middle foot portion 100M. In a portion of the exposed region 150A that is located on a front side in the middle foot portion 100M, the first exposed region 150AA is located on the lateral foot side, and the second exposed region 150AB is located on the medial foot side.

Thus, when the load of the wearer's foot is applied also to the front side portion in the middle foot portion 100M during running, the braking effect on the lateral foot side and the acceleration effect on the medial foot side can be further enhanced.

In the present embodiment, a rear end 150AE of the exposed region 150A is located at a portion that supports the lateral foot side of the wearer's foot.

Thereby, in the vicinity of the rear end 150AE, the portion of the plate portion 150 that supports the medial foot side of the wearer's foot can be suppressed from displacing downward z2 to be twisted, upon coming into contact with the ground, with respect to the portion of the plate portion 150 that supports the lateral foot side.

In the present embodiment, when viewed in an up-down direction z, a dimension from a tip end 102 of the shoe sole 100 to a rear end 150AE of the exposed region 150A in the front-rear direction y is 20% or more and 75% or less of a dimension of the shoe sole 100 in the front-rear direction y.

Thereby, a portion to be formed as the accommodated region 150B can be ensured to some extent, so that the middle foot portion 100M or the rear foot portion 100R can be sufficiently significantly inclined upward z1, and thus, the effect of causing the heel portion of the wearer's foot to bounce up by the plate portion 150 can be further improved.

Further, according to the present embodiment, in the middle foot portion 100M, the plate portion 150 has a narrow region 150G in which a side edge on a medial foot side is curved in a shape recessed toward a center in a foot width direction x. In the narrow region 150G, the plate portion 150 is curved in the shape protruding downward.

Thereby, rigidity reduction can be suppressed in the narrow region 150G in which the length in the foot width direction x is relatively short.

Modifications

The following describes a shoe sole according to each of modifications of one embodiment of the present invention. In the following description of each of the modifications, the same or corresponding components as those of the shoe sole 100 according to one embodiment of the present invention will be denoted by the same reference characters, and the description of the same components as those of the shoe sole 100 will not be repeated. Further, among the components of the shoe sole according to each of the following modifications, any components corresponding to the respective components in one embodiment of the present invention may have the same reference characters additionally with suffixes "a" to "z", "aa" to "az", and "ba" to "bc".

It should be noted that the figures each showing a shoe sole according to each of the following modifications may not show protrusions, but a plurality of protrusions are provided in the entire exposed region in each of the following modifications.

Figure 16:
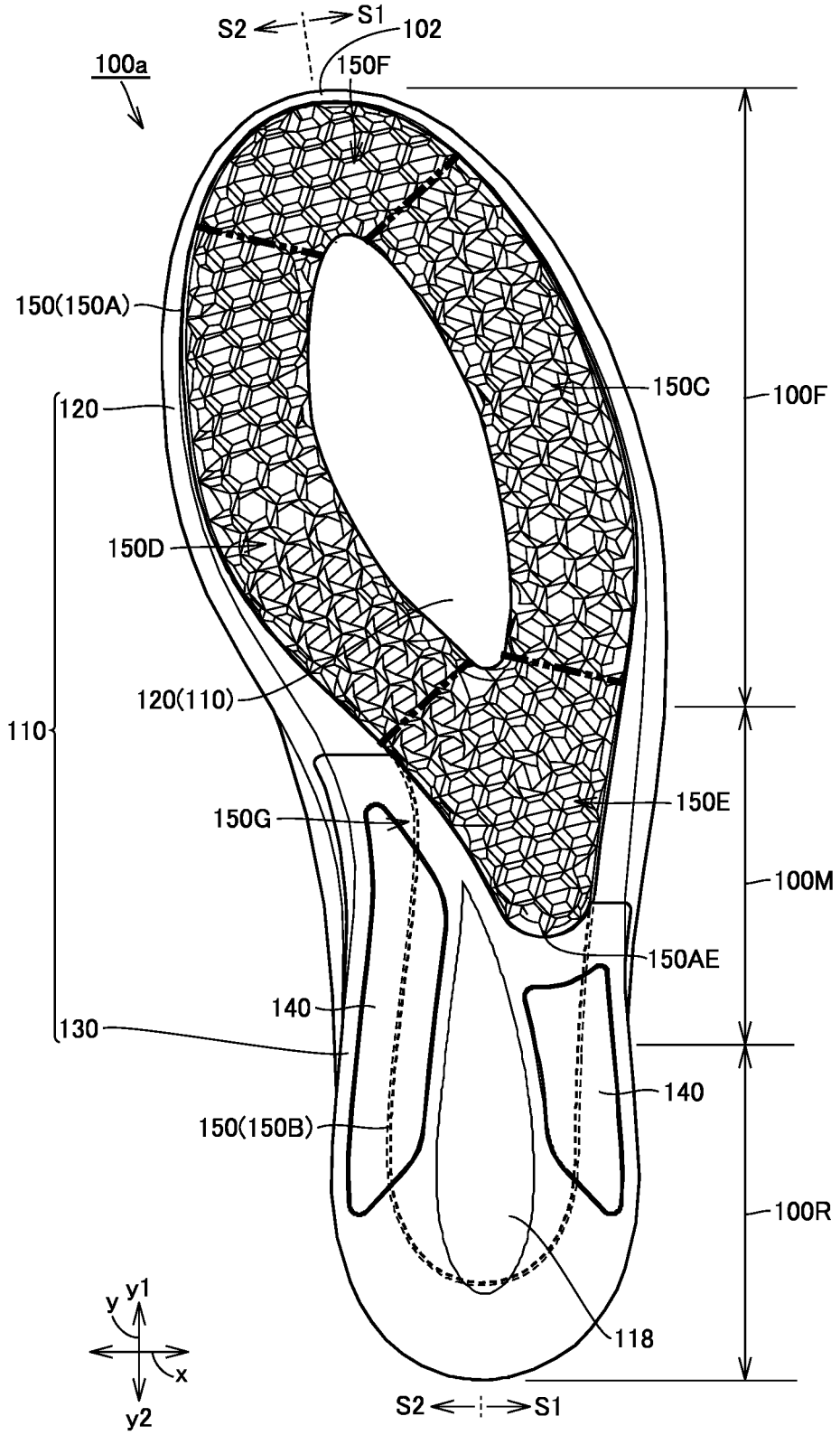
FIG. 16 is a bottom view of a shoe sole according to a first modification as viewed from below.

FIG. 16 is a bottom view of a shoe sole according to a first modification as viewed from below. As shown in FIG. 16, in a shoe sole 100*a* according to the first modification, the plate portion 150 does not have the beam portion 151 in one embodiment as described above. Thus, the entire lateral foot side region 150C and the entire medial foot side region 150D are spaced apart from each other. In the first modification, therefore, in a portion of the plate portion 150 where the lateral foot side region 150C and the medial foot side region 150D are located in the front-rear direction y, the rigidity is relatively low and the flexibility is relatively improved. Also, the plate portion 150 is reduced in weight.

Figure 17:
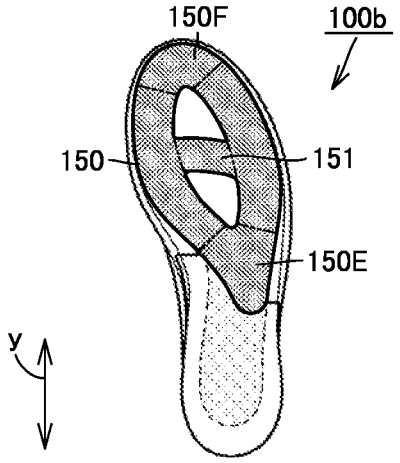
FIG. 17 is a bottom view of a shoe sole according to a second modification as viewed from below.

FIG. 17 is a bottom view of a shoe sole according to a second modification as viewed from below. As shown in FIG. 17, in a shoe sole 100*b* according to the second modification, the beam portion 151 is located at the center between the tip end region 150F and the rear side region 150E in the front-rear direction y. This makes it difficult to restrict the direction in which the plate portion 150 tends to be curved while the wearer is running. Further, the grip force by the protrusions provided on the plate portion 150 is relatively improved.

Figure 18:
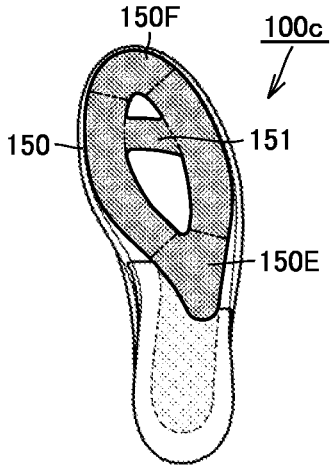
FIG. 18 is a bottom view of a shoe sole according to a third modification as viewed from below.

FIG. 18 is a bottom view of a shoe sole according to a third modification as viewed from below. As shown in FIG. 18, in a shoe sole 100*c* according to the third modification, the beam portion 151 is located closer to the tip end region 150F than to the rear side region 150E. Thereby, the portion of the plate portion 150 that supports an MP joint is reduced in rigidity and improved in flexibility.

Figure 19:
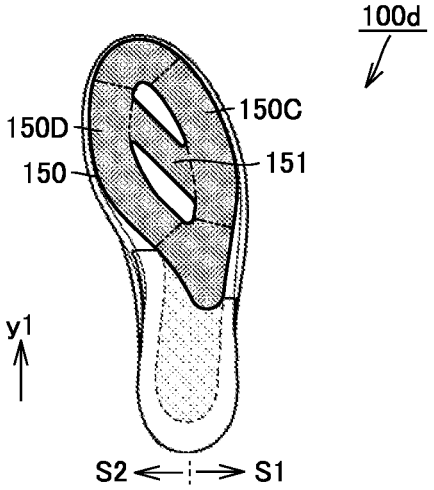
FIG. 19 is a bottom view of a shoe sole according to a fourth modification as viewed from below.
Figure 20:
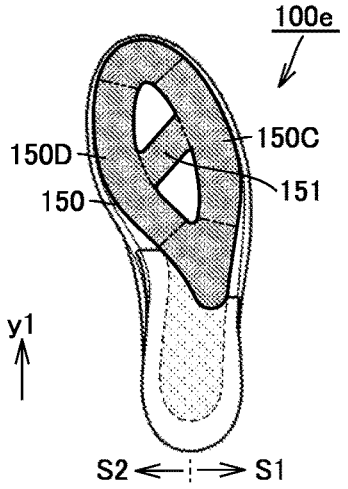
FIG. 20 is a bottom view of a shoe sole according to a fifth modification as viewed from below.

FIG. 19 is a bottom view of a shoe sole according to a fourth modification as viewed from below. As shown in FIG. 19, in a shoe sole 100*d* according to the fourth modification, a portion of the beam portion 151 that is connected to the medial foot side region 150D is located more forward y1 than a portion of the beam portion 151 that is connected to the lateral foot side region 150C. Thereby, the plate portion 150 is less likely to deform toward the medial foot side S2 when the shoe sole comes into contact with the ground, so that the pronation of the wearer's foot can be suppressed. FIG. 20 is a bottom view of a shoe sole according to a fifth modification as viewed from below. As shown in FIG. 20, in a shoe sole 100*e* according to the fifth modification, a portion of the beam portion 151 that is connected to the lateral foot side region 150C is located more forward y1 than a portion of the beam portion 151 that is connected to the medial foot side region 150D. Thereby, the plate portion 150 is less likely to deform toward the lateral foot side S1 when the shoe sole kicks the ground, so that the wearer's foot can smoothly kick the ground.

Figure 21:
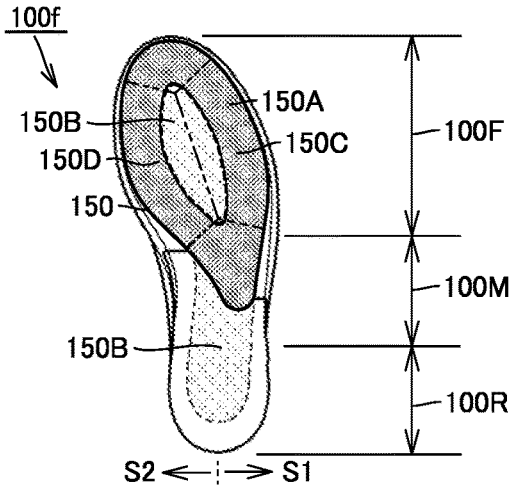
FIG. 21 is a bottom view of a shoe sole according to a sixth modification as viewed from below.

FIG. 21 is a bottom view of a shoe sole according to a sixth modification as viewed from below. As shown in FIG. 21, in a shoe sole 100*f* according to the sixth modification, the lateral foot side region 150C and the medial foot side region 150D are not spaced apart from each other due to the accommodated region 150B existing in the plate portion 150. In other words, as viewed in the up-down direction, the accommodated region 150B is further located so as to be surrounded by the exposed region 150A in the front foot portion 100F. Thereby, the resilience of the shoe sole 100*f* is relatively improved.

Figure 22:
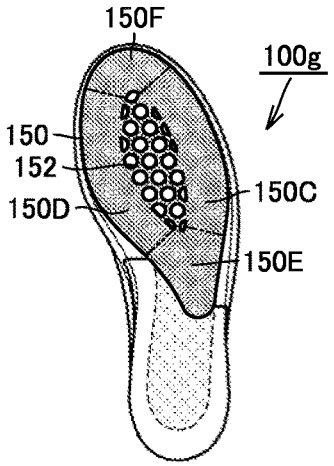
FIG. 22 is a bottom view of a shoe sole according to a seventh modification as viewed from below.

FIG. 22 is a bottom view of a shoe sole according to a seventh modification as viewed from below. As shown in FIG. 22, in a shoe sole 100*g* according to the seventh modification, the plate portion 150 includes a mesh portion 152 that connects, in a mesh-like manner, the lateral foot side region 150C and the medial foot side region 150D between the tip end region 150F and the rear side region 150E. Thus, in a portion of the plate portion 150 that is located forward of the rear side region 150E, the rigidity of the plate portion 150 can be increased while suppressing an excessive load applied to the wearer when the wearer kicks the ground.

Figure 23:
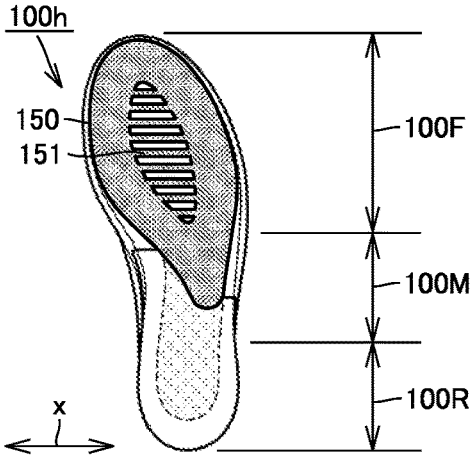
FIG. 23 is a bottom view of a shoe sole according to an eighth modification as viewed from below.

FIG. 23 is a bottom view of a shoe sole according to an eighth modification as viewed from below. As shown in FIG. 23, in a shoe sole 100*h* according to the eighth modification, the plate portion 150 has a plurality of beam portions 151 spaced apart from each other. Each of the plurality of beam portions 151 extends in the foot width direction x. Thereby, the protrusions provided on the beam portion 151 improve the grip force of the shoe sole 100*h*. Further, the flexibility of the front foot portion 100F can be enhanced.

Figure 24:
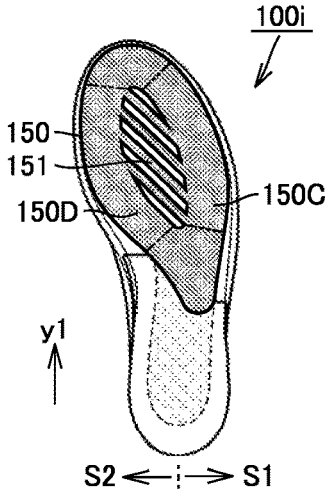
FIG. 24 is a bottom view of a shoe sole according to a ninth modification as viewed from below.

FIG. 24 is a bottom view of a shoe sole according to a ninth modification as viewed from below. As shown in FIG. 24, in a shoe sole 100*i* according to the ninth modification, the plate portion 150 has a plurality of beam portions 151 spaced apart from each other. In each of the plurality of beam portions 151, a portion of the beam portion 151 that is connected to the medial foot side region 150D is located more forward y1 than a portion of the beam portion 151 that is connected to the lateral foot side region 150C. Thereby, the plate portion 150 is less likely to deform toward the medial foot side S2 when the wearer kicks the ground, so that pronation of the wearer's foot can be suppressed.

Figure 25:
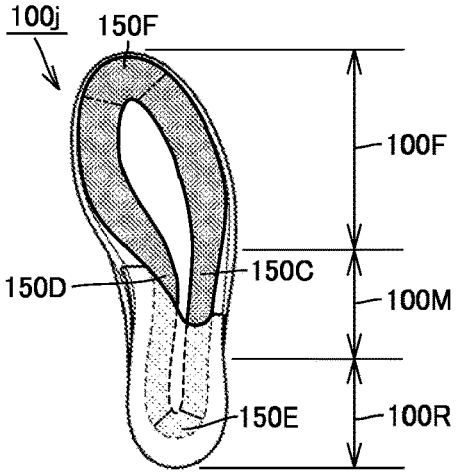
FIG. 25 is a bottom view of a shoe sole according to a tenth modification as viewed from below.

FIG. 25 is a bottom view of a shoe sole according to a tenth modification as viewed from below. As shown in FIG. 25, in a shoe sole 100*j* according to the tenth modification, the lateral foot side region 150C and the medial foot side region 150D are located in the front foot portion 100F, the middle foot portion 100M, and the rear foot portion 100R. Further, the entire lateral foot side region 150C and the entire medial foot side region 150D are spaced apart from each other. Thereby, the shoe sole 100*j* can be reduced in weight while maintaining its rigidity.

Figure 26:
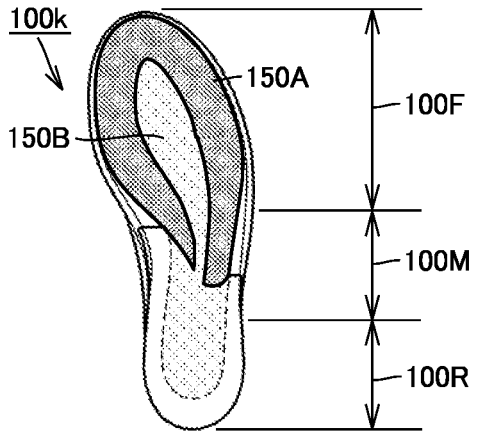
FIG. 26 is a bottom view of a shoe sole according to an eleventh modification as viewed from below.

FIG. 26 is a bottom view of a shoe sole according to an eleventh modification as viewed from below. As shown in FIG. 26, in a shoe sole 100*k* according to the eleventh modification, the exposed region 150A is formed in a substantially U-shape as viewed in the up-down direction. Further, the accommodated region 150B is located in the front foot portion 100F, the middle foot portion 100M, and the rear foot portion 100R. This improves the resilience of the shoe sole 100*k*.

Figure 27:
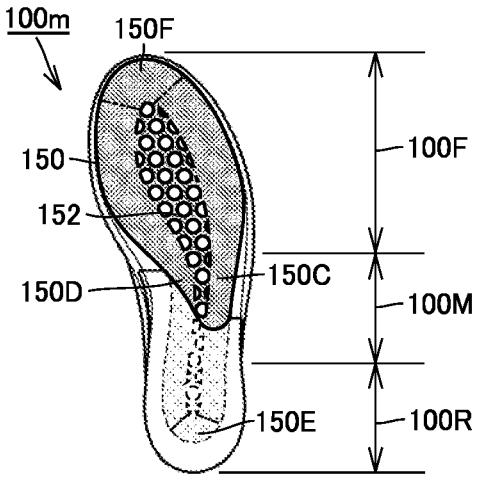
FIG. 27 is a bottom view of a shoe sole according to a twelfth modification as viewed from below.

FIG. 27 is a bottom view of a shoe sole according to a twelfth modification as viewed from below. As shown in FIG. 27, in a shoe sole 100*m* according to the twelfth modification, the lateral foot side region 150C and the medial foot side region 150D are located in the front foot portion 100F, the middle foot portion 100M, and the rear foot portion 100R. Further, the shoe sole 100*m* includes a mesh portion 152 that connects, in a mesh-like manner, the lateral foot side region 150C and the medial foot side region 150D between the tip end region 150F and the rear side region 150E. Thereby, the plate portion 150 can be increased in rigidity and also can be reduced in weight.

Figure 28:
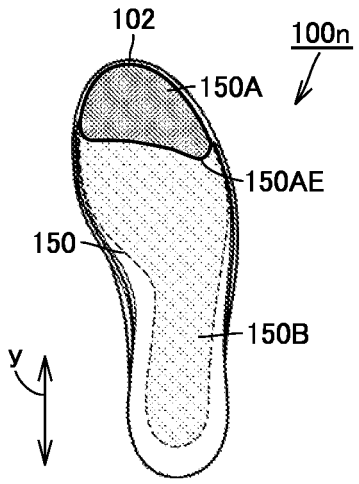
FIG. 28 is a bottom view of a shoe sole according to a thirteenth modification as viewed from below.

FIG. 28 is a bottom view of a shoe sole according to a thirteenth modification as viewed from below. As shown in FIG. 28, in a shoe sole 100*n* according to the thirteenth modification, the dimension from the tip end 102 of the shoe sole 100*n* to the rear end 150AE of the exposed region 150A in the front-rear direction y is approximately 20% of the dimension of the shoe sole 100*n* in the front-rear direction y. Thereby, the plate portion 150 can be disposed so as to reduce the rigidity of the shoe sole 100*n*.

Figure 29:
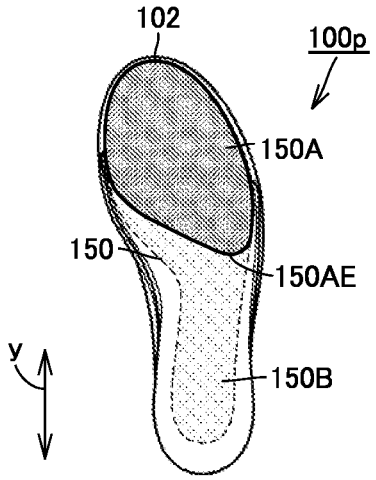
FIG. 29 is a bottom view of a shoe sole according to a fourteenth modification as viewed from below.
Figure 30:
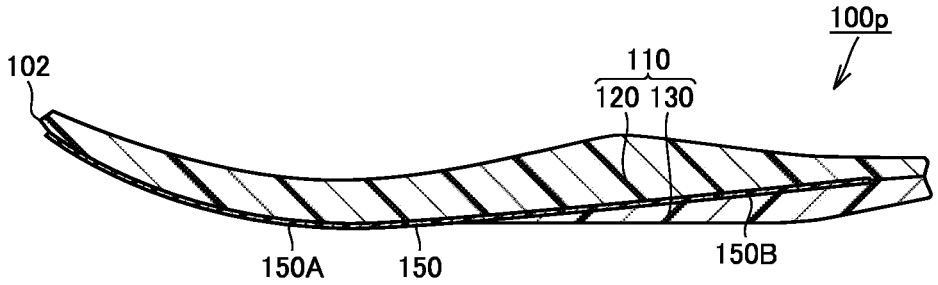
FIG. 30 is a cross-sectional view of the shoe sole according to the fourteenth modification.

FIG. 29 is a bottom view of a shoe sole according to a fourteenth modification as viewed from below. FIG. 30 is a cross-sectional view of the shoe sole according to the fourteenth modification. FIG. 30 shows the shoe sole in a cross-sectional view similar to that in FIG. 5. As shown in FIGS. 29 and 30, in a shoe sole 100*p* according to the fourteenth modification, the dimension from the tip end 102 of the shoe sole 100*p* to the rear end 150AE of the exposed region 150A in the front-rear direction y is approximately 40% of the dimension of the shoe sole 100*n* in the front-rear direction y. Thereby, the plate portion 150 can be formed so as to enhance the bouncing-up effect by the plate portion 150.

Figure 31:
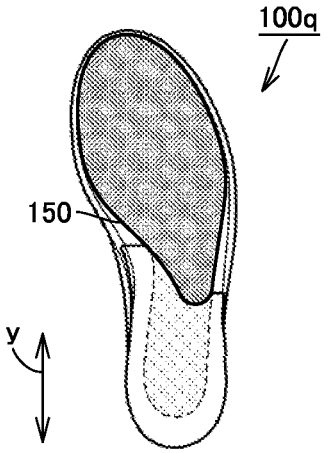
FIG. 31 is a bottom view of a shoe sole according to a fifteenth modification as viewed from below.
Figure 32:
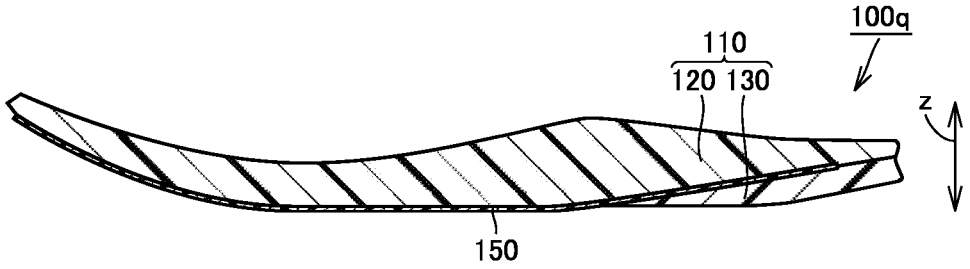
FIG. 32 is a cross-sectional view of the shoe sole according to the fifteenth modification.

FIG. 31 is a bottom view of a shoe sole according to a fifteenth modification as viewed from below. FIG. 32 is a cross-sectional view of the shoe sole according to the fifteenth modification. FIG. 32 shows the shoe sole in a cross-sectional view similar to that in FIG. 5. As shown in FIGS. 31 and 32, a shoe sole 100*q* according to the fifteenth modification has a portion extending in a direction orthogonal to the up-down direction z at the center of the plate portion 150 in the front-rear direction y.

Figure 33:
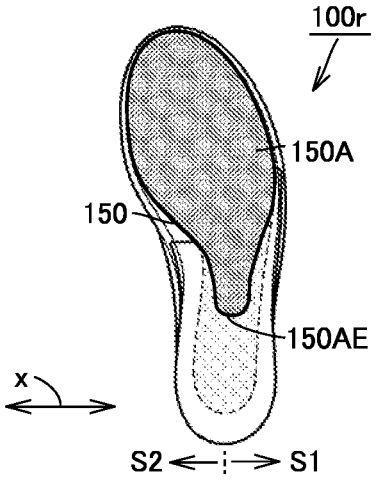
FIG. 33 is a bottom view of a shoe sole according to a sixteenth modification as viewed from below.

FIG. 33 is a bottom view of a shoe sole according to a sixteenth modification as viewed from below. As shown in FIG. 33, in a shoe sole 100*r* according to the sixteenth modification, the rear end 150AE of the exposed region 150A is located at the center of the shoe sole 100*r* in the foot width direction x. Thus, in the vicinity of the rear end 150AE, the plate portion 150 can be suppressed from being easily twisted toward only one of the lateral foot side S1 and the medial foot side S2 when the shoe sole comes into contact with the ground.

Figure 34:
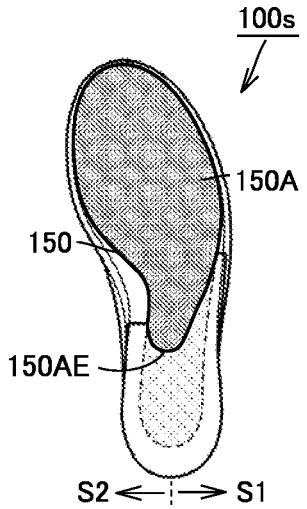
FIG. 34 is a bottom view of a shoe sole according to a seventeenth modification as viewed from below.

FIG. 34 is a bottom view of a shoe sole according to a seventeenth modification as viewed from below. As shown in FIG. 34, in a shoe sole 100*s* according to the seventeenth modification, the rear end 150AE of the exposed region 150A is located in a portion that supports the medial foot side of the wearer's foot (on the medial foot side S2 of the shoe sole 100*s*). Thereby, when the shoe sole comes into contact with the ground, in the vicinity of the rear end 150AE, a portion (S1) of the plate portion 150 that supports the lateral foot side of the wearer's foot can be suppressed from displacing downward with respect to a portion (S2) of the plate portion 150 that supports the medial foot side.

Figure 35:
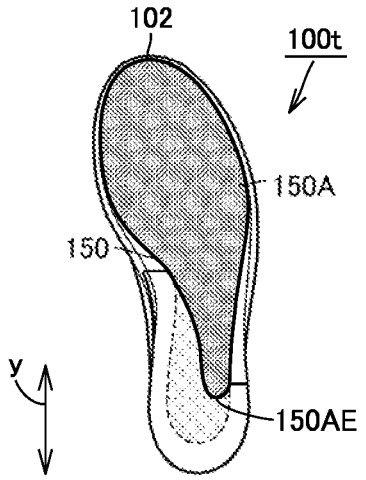
FIG. 35 is a bottom view of a shoe sole according to an eighteenth modification as viewed from below.
Figure 36:
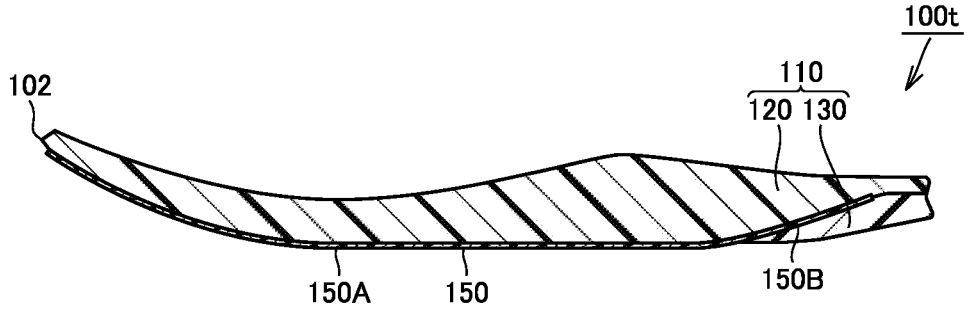
FIG. 36 is a cross-sectional view of the shoe sole according to the eighteenth modification.

FIG. 35 is a bottom view of a shoe sole according to an eighteenth modification as viewed from below. FIG. 36 is a cross-sectional view of the shoe sole according to the eighteenth modification. FIG. 36 shows the shoe sole in a cross-sectional view similar to that in FIG. 5. As shown in FIGS. 35 and 36, in a shoe sole 100*t* according to the eighteenth modification, the dimension from the tip end 102 of the shoe sole 100*t* to the rear end 150AE of the exposed region 150A in the front-rear direction y is approximately 80% of the dimension of the shoe sole 100*t* in the front-rear direction y. Thereby, the plate portion 150 can be formed so as to be increased in rigidity. Further, the grip force by the protrusions provided in the exposed region 150A is improved.

Figure 37:
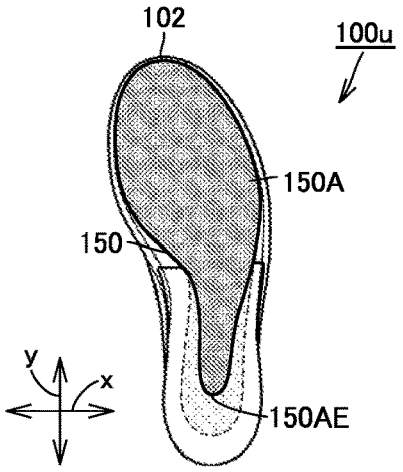
FIG. 37 is a bottom view of a shoe sole according to a nineteenth modification as viewed from below.

FIG. 37 is a bottom view of a shoe sole according to a nineteenth modification as viewed from below. As shown in FIG. 37, in a shoe sole 100*u* according to the nineteenth modification, the dimension from the tip end 102 of the shoe sole 100*u* to the rear end 150AE of the exposed region 150A in the front-rear direction y is approximately 80% of the dimension of the shoe sole 100*u* in the front-rear direction y. Thereby, the plate portion 150 can be formed so as to be increased in rigidity. In the shoe sole 100*u*, the rear end 150AE of the exposed region 150A is located at the center of the shoe sole 100 in the foot width direction x.

Figure 38:
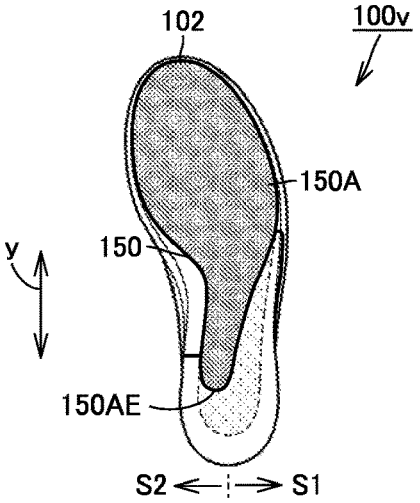
FIG. 38 is a bottom view of a shoe sole according to a twentieth modification as viewed from below.

FIG. 38 is a bottom view of a shoe sole according to a twentieth modification as viewed from below. As shown in FIG. 38, in a shoe sole 100*v* according to the twentieth modification, the dimension from the tip end 102 of the shoe sole 100*v* to the rear end 150AE of the exposed region 150A in the front-rear direction y is approximately 80% of the dimension of the shoe sole 100 in the front-rear direction y. Thereby, the plate portion 150 can be formed so as to be increased in rigidity. In the shoe sole 100*u*, the rear end 150AE of the exposed region 150A is located at a portion that supports the medial foot side of the foot of the wearer (on the medial foot side S2 of the shoe sole 100).

Figure 39:
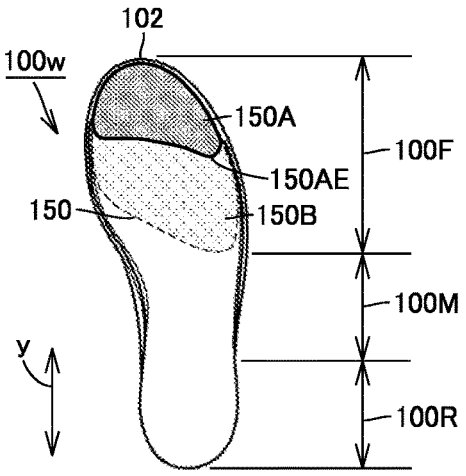
FIG. 39 is a bottom view of a shoe sole according to a twenty-first modification as viewed from below.

FIG. 39 is a bottom view of a shoe sole according to a twenty-first modification as viewed from below. As shown in FIG. 39, in a shoe sole 100*w* according to the nineteenth modification, the plate portion 150 is located only in the front foot portion 100F. The dimension from the tip end 102 of the shoe sole 100*w* to the rear end 150AE of the exposed region 150A in the front-rear direction y is approximately 20% of the dimension of the shoe sole 100*w* in the front-rear direction y. Thereby, the plate portion 150 can be reduced in weight.

Figure 40:
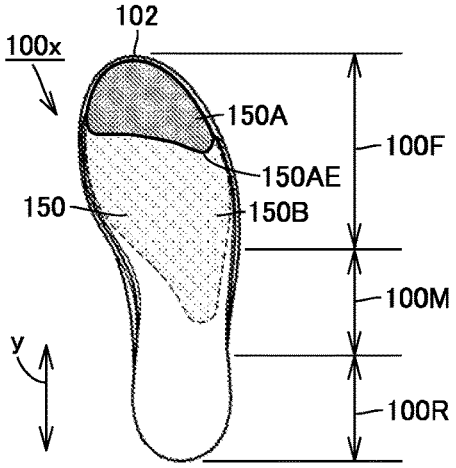
FIG. 40 is a bottom view of a shoe sole according to a twenty-second modification as viewed from below.

FIG. 40 is a bottom view of a shoe sole according to a twenty-second modification as viewed from below. As shown in FIG. 40, in a shoe sole 100*x* according to the twenty-second modification, the plate portion 150 is located only in the front foot portion 100F and the middle foot portion 100M. Further, the dimension from the tip end 102 of the shoe sole 100*x* to the rear end 150AE of the exposed region 150A is approximately 20% of the dimension of the shoe sole 100*x* in the front-rear direction y. Thereby, the plate portion 150 can be reduced in weight.

Figure 41:
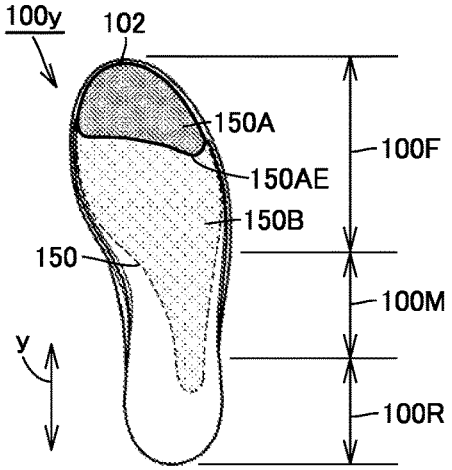
FIG. 41 is a bottom view of a shoe sole according to a twenty-third modification as viewed from below.

FIG. 41 is a bottom view of a shoe sole according to a twenty-third modification as viewed from below. As shown in FIG. 41, in a shoe sole 100*y* according to the twenty-third modification, the plate portion 150 is located forward of the center of the rear foot portion 100R in the front-rear direction y. Further, the dimension from the tip end 102 of the shoe sole 100*y* to the rear end 150AE of the exposed region 150A is approximately 20% of the dimension of the shoe sole 100*y* in the front-rear direction y. Thereby, the plate portion 150 can be disposed so as to reduce the rigidity of the shoe sole 100*y*.

Figure 42:
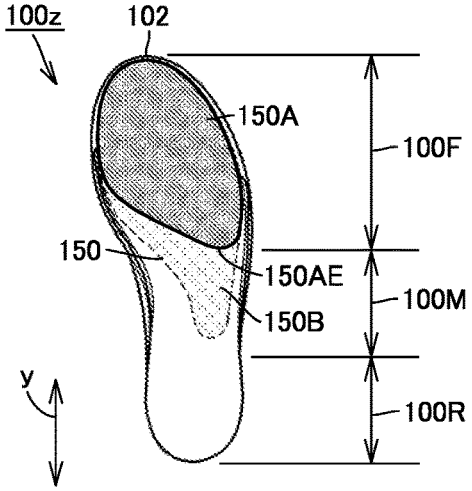
FIG. 42 is a bottom view of a shoe sole according to a twenty-fourth modification as viewed from below.

FIG. 42 is a bottom view of a shoe sole according to a twenty-fourth modification as viewed from below. As shown in FIG. 42, in a shoe sole 100*z* according to the twenty-fourth modification, the plate portion 150 is located only in the front foot portion 100F and the middle foot portion 100M. Further, the dimension from the tip end 102 of the shoe sole 100*z* to the rear end 150AE of the exposed region 150A is approximately 40% of the dimension of the shoe sole 100*z* in the front-rear direction y.

Figure 43:
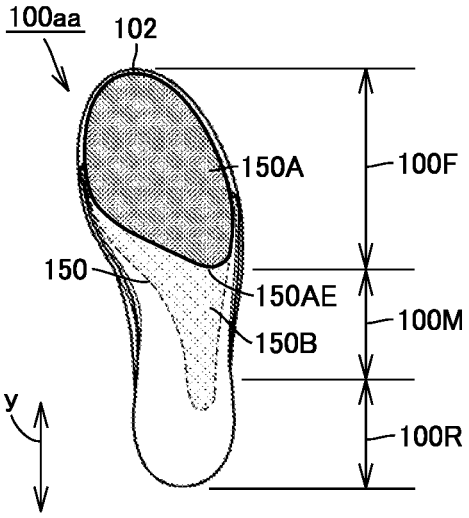
FIG. 43 is a bottom view of a shoe sole according to a twenty-fifth modification as viewed from below.

FIG. 43 is a bottom view of a shoe sole according to a twenty-fifth modification as viewed from below. As shown in FIG. 43, in a shoe sole 100*aa* according to the twenty-fifth modification, the plate portion 150 is located forward of the center of the rear foot portion 100R in the front-rear direction y. Further, the dimension from the tip end 102 of the shoe sole 100*aa* to the rear end 150AE of the exposed region 150A is approximately 40% of the dimension of the shoe sole 100*z* in the front-rear direction y.

Figure 44:
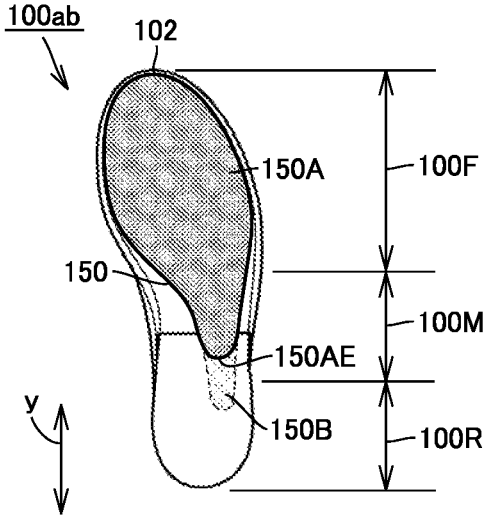
FIG. 44 is a bottom view of a shoe sole according to a twenty-sixth modification as viewed from below.

FIG. 44 is a bottom view of a shoe sole according to a twenty-sixth modification as viewed from below. As shown in FIG. 44, in a shoe sole 100*ab* according to the twenty-sixth modification, the plate portion 150 is located forward of the center of the rear foot portion 100R in the front-rear direction y. Further, the dimension from the tip end 102 of the shoe sole 100*ab* to the rear end 150AE of the exposed region 150A is approximately 60% of the dimension of the shoe sole 100*z* in the front-rear direction y. Thereby, the plate portion 150 can be formed so as to be increased in flexural rigidity.

In the thirteenth to twenty-sixth modifications shown in FIGS. 28 to 44, the lateral foot side region and the medial foot side region of the plate portion 150 are not spaced apart from each other, but may be spaced apart from each other as in the shoe sole 100 according to one embodiment of the present invention.

Figure 45:
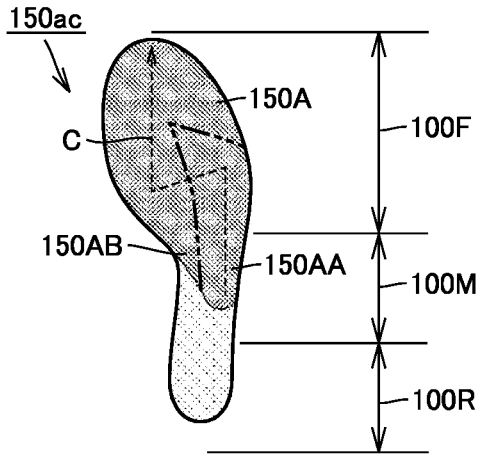
FIG. 45 is a bottom view of a plate portion of a shoe sole according to a twenty-seventh modification as viewed from below.

FIG. 45 is a bottom view of a plate portion of a shoe sole according to a twenty-seventh modification as viewed from below. As shown in FIG. 45, in a plate portion 150*ac* of the twenty-seventh modification, in the entire exposed region 150A located in the middle foot portion 100M, the first exposed region 150AA is located on the lateral foot side S1 and the second exposed region 150AB is located on the medial foot side S2. Thereby, the thrust force for the wearer who is running can be increased when the center of gravity of the load shifts as indicated by a dotted line C as shown in FIG. 45.

Figure 46:
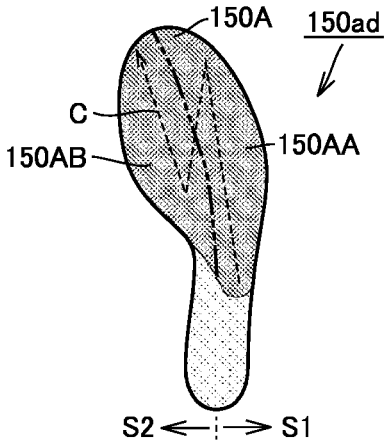
FIG. 46 is a bottom view of a plate portion of a shoe sole according to a twenty-eighth modification as viewed from below.

FIG. 46 is a bottom view of a plate portion of a shoe sole according to a twenty-eighth modification as viewed from below. As shown in FIG. 46, in a plate portion 150*ad* of the twenty-eighth modification, in the entire exposed region 150A, the first exposed region 150AA is located on the lateral foot side and the second exposed region 150AB is located on the medial foot side. Thereby, the thrust force can be increased when the center of gravity of the load shifts as indicated by a dotted line C as shown in FIG. 46 (when the shoe sole comes into contact with the ground on its lateral foot side S1 and kicks the ground on its medial foot side S2).

Figure 47:
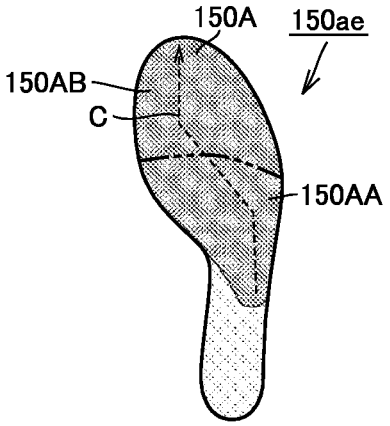
FIG. 47 is a bottom view of a plate portion of a shoe sole according to a twenty-ninth modification as viewed from below.

FIG. 47 is a bottom view of a plate portion of a shoe sole according to a twenty-ninth modification as viewed from below. As shown in FIG. 47, in a plate portion 150*ae* of the twenty-ninth modification, in the exposed region 150A, the first exposed region 150AA is located rearward of the portion supporting the MP joint, and the second exposed region 150AB is located forward of the portion supporting the MP joint. Thereby, the thrust force can be increased when the center of gravity of the load shifts as indicated by a dotted line C as shown in FIG. 47 (when a portion of the shoe sole that is located mainly at a position of the MP joint comes into contact with the ground).

Figure 48:
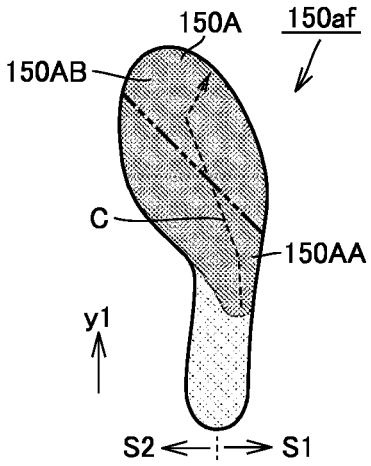
FIG. 48 is a bottom view of a plate portion of a shoe sole according to a thirtieth modification as viewed from below.

FIG. 48 is a bottom view of a plate portion of a shoe sole according to a thirtieth modification as viewed from below. As shown in FIG. 48, in a plate portion 150*af* of the thirtieth modification, in the exposed region 150A, the first exposed region 150AA is located in the rear side portion and the second exposed region 150AB is located in the front side portion. Also, the boundary between the first exposed region 150AA and the second exposed region 150AB is inclined toward the medial foot side S2 as the boundary extends forward y1. Thereby, the thrust force can be increased when the center of gravity of the load shifts as indicated by a dotted line C as shown in FIG. 48 (when the wearer's foot kicks the ground mainly toward the lateral foot side S1).

Figure 49:
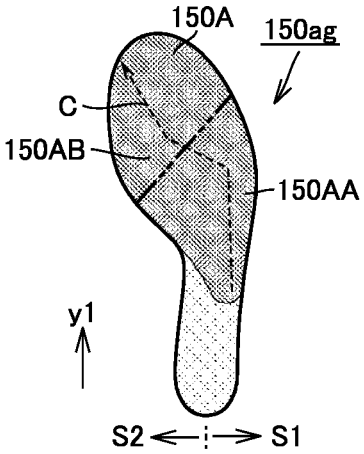
FIG. 49 is a bottom view of a plate portion of a shoe sole according to a thirty-first modification as viewed from below.

FIG. 49 is a bottom view of a plate portion of a shoe sole according to a thirty-first modification as viewed from below. As shown in FIG. 49, in a plate portion 150*ag* of the thirty-first modification, in the exposed region 150A, the first exposed region 150AA is located in the rear side portion and the second exposed region 150AB is located in the front side portion. The boundary between the first exposed region 150AA and the second exposed region 150AB is inclined toward the lateral foot side S1 as the boundary extends forward y1. Thereby, the thrust force can be increased when the center of gravity of the load shifts as indicated by a dotted line C as shown in FIG. 49 (when the wearer's foot kicks the ground mainly toward the medial foot side S2).

Figure 50:
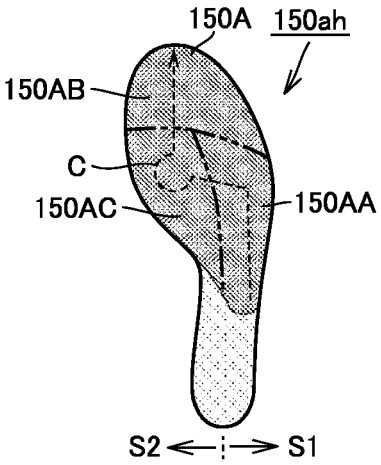
FIG. 50 is a bottom view of a plate portion of a shoe sole according to a thirty-second modification as viewed from below.

FIG. 50 is a bottom view of a plate portion of a shoe sole according to a thirty-second modification as viewed from below. As shown in FIG. 50, in a plate portion 150*ah* of the thirty-second modification, the exposed region 150A further includes a third exposed region 150AC. The third exposed region 150AC is located on the medial foot side S2 when viewed from the first exposed region 150AA. The second exposed region 150AB is located forward of the first exposed region 150AA and the third exposed region 150AC. The third exposed region 150AC may be provided with a plurality of second protrusions or may be provided with a plurality of protrusions that each are configured to rotate in a grip direction about the center of a corresponding one of the protrusions as viewed from below, as will be described later. Thereby, the thrust force can be increased when the center of gravity of the load shifts as indicated by a dotted line C as shown in FIG. 50 (when the direction of force rotates that is applied to the ground contact surface while the wearer's foot comes into contact with the ground and then kicks the ground).

Figure 51:
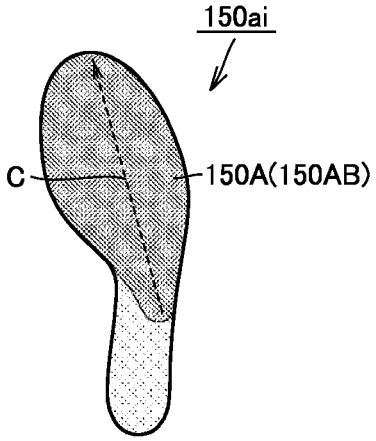
FIG. 51 is a bottom view of a plate portion of a shoe sole according to a thirty-third modification as viewed from below.

FIG. 51 is a bottom view of a plate portion of a shoe sole according to a thirty-third modification as viewed from below. As shown in FIG. 51, in a plate portion 150*ai* of the thirty-third modification, the second exposed region 150AB is located in the entire exposed region 150A. Thereby, the thrust force can be increased when the center of gravity of the load shifts as indicated by a dotted line C as shown in FIG. 51, or when the center of gravity shifts unstably.

In the twenty-seventh to thirty-third modifications shown in FIGS. 45 to 51, the lateral foot side region and the medial foot side region of the plate portion are not spaced apart from each other, but may be spaced apart from each other as in the shoe sole 100 according to one embodiment of the present invention.

Figure 52:
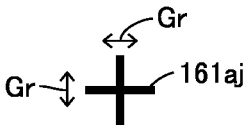
FIG. 52 is a diagram showing only a tip end of a protrusion in a shoe sole according to a thirty-fourth modification as viewed from below.

FIG. 52 is a diagram showing only a tip end of a protrusion in a shoe sole according to a thirty-fourth modification as viewed from below. As shown in FIG. 52, a tip end 161*aj* of the protrusion in the thirty-fourth modification may have a cross-like outer shape as viewed from below. The protrusion functions in two grip directions Gr.

Figure 53:
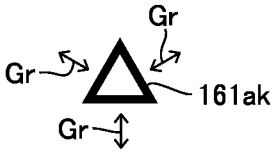
FIG. 53 is a diagram showing only a tip end of a protrusion in a shoe sole according to a thirty-fifth modification as viewed from below.

FIG. 53 is a diagram showing only a tip end of a protrusion in a shoe sole according to a thirty-fifth modification as viewed from below. As shown in FIG. 53, a tip end 161*ak* of the protrusion in the thirty-fifth modification may have a triangular outer shape as viewed from below. The protrusion functions in three grip directions Gr.

Figure 54:
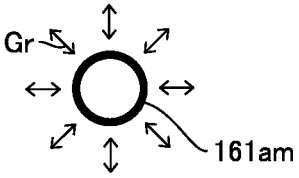
FIG. 54 is a diagram showing only a tip end of a protrusion in a shoe sole according to a thirty-sixth modification as viewed from below.

FIG. 54 is a diagram showing only a tip end of a protrusion in a shoe sole according to a thirty-sixth modification as viewed from below. As shown in FIG. 54, a tip end 161*am* of the protrusion in the thirty-sixth modification may have an annular outer shape as viewed from below. The protrusion functions in a large number of grip directions Gr.

Figure 55:
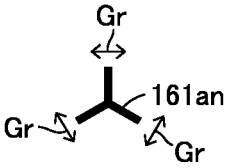
FIG. 55 is a diagram showing only a tip end of a protrusion in a shoe sole according to a thirty-seventh modification as viewed from below.

FIG. 55 is a diagram showing only a tip end of a protrusion in a shoe sole according to a thirty-seventh modification as viewed from below. As shown in FIG. 55, a tip end 161*an* of the protrusion in the thirty-seventh modification may extend radially in three directions as viewed from below. The protrusion functions in three grip directions Gr.

Figure 56:
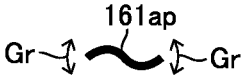
FIG. 56 is a diagram showing only a tip end of a protrusion in a shoe sole according to a thirty-eighth modification as viewed from below.

FIG. 56 is a diagram showing only a tip end of a protrusion in a shoe sole according to a thirty-eighth modification as viewed from below. As shown in FIG. 56, a tip end 161*ap* of the protrusion in the thirty-eighth modification may have a wave-like outer shape as viewed from below. The protrusion functions in a grip direction Gr along the rotation direction.

Figure 57:
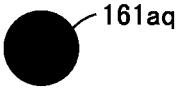
FIG. 57 is a diagram showing only a tip end of a protrusion in a shoe sole according to a thirty-ninth modification as viewed from below.

FIG. 57 is a diagram showing only a tip end of a protrusion in a shoe sole according to a thirty-ninth modification as viewed from below. As shown in FIG. 57, a tip end 161*aq* of the protrusion in the thirty-ninth modification has a circular outer shape as viewed from below. The protrusion is relatively high in strength.

Figure 58:
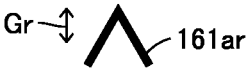
FIG. 58 is a diagram showing only a tip end of a protrusion in a shoe sole according to a fortieth modification as viewed from below.

FIG. 58 is a diagram showing only a tip end of a protrusion in a shoe sole according to a fortieth modification as viewed from below. As shown in FIG. 58, a tip end 161*ar* of the protrusion in the fortieth modification has a V-shaped outer shape as viewed from below. The protrusion functions in one grip direction Gr and exhibits high grip force.

It should be noted that the protrusions according to the thirty-fourth, thirty-fifth, thirty-seventh, and fortieth modifications shown in FIGS. 52, 53, 55, and 58, respectively, each may be the first protrusion or the second protrusion.

Figure 59:
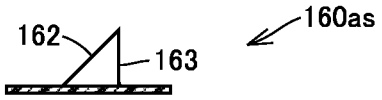
FIG. 59 is a diagram showing a protrusion in a shoe sole according to a forty-first modification as viewed in a direction orthogonal to a grip direction and an up-down direction.

FIG. 59 is a diagram showing a protrusion in a shoe sole according to a forty-first modification as viewed in a direction orthogonal to a grip direction and an up-down direction. As shown in FIG. 59, in the forty-first modification, a protrusion 160*as* may have a flat inclined surface 162 and a steeply inclined surface 163.

Figure 60:
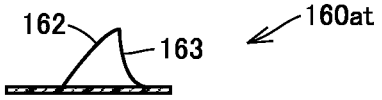
FIG. 60 is a diagram showing a protrusion in a shoe sole according to a forty-second modification as viewed in a direction orthogonal to a grip direction and an up-down direction.

FIG. 60 is a diagram showing a protrusion in a shoe sole according to a forty-second modification as viewed in a direction orthogonal to a grip direction and an up-down direction. As shown in FIG. 60, in the forty-second modification, a protrusion 160*at* may have an inclined surface 162 curved in a protruding shape.

Figure 61:
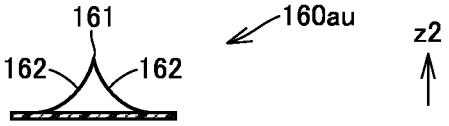
FIG. 61 is a diagram showing a protrusion in a shoe sole according to a forty-third modification as viewed in a direction orthogonal to a grip direction and an up-down direction.

FIG. 61 is a diagram showing a protrusion in a shoe sole according to a forty-third modification as viewed in a direction orthogonal to a grip direction and an up-down direction. As shown in FIG. 61, in the forty-third modification, a protrusion 160*au* may not have a steeply inclined surface but may have inclined surfaces 162 (a pair of inclined surfaces 162) on one side and the other side of the tip end 161 when viewed from below.

Figure 62:
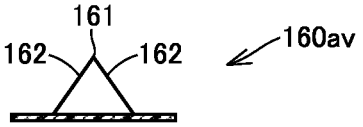
FIG. 62 is a diagram showing a protrusion in a shoe sole according to a forty-fourth modification as viewed in a direction orthogonal to a grip direction and an up-down direction.

FIG. 62 is a diagram showing a protrusion in a shoe sole according to a forty-fourth modification as viewed in a direction orthogonal to a grip direction and an up-down direction. As shown in FIG. 62, in the forty-fourth modification, a protrusion 160*av* may not have a steeply inclined surface as in the forty-third modification, but may have a pair of planar inclined surfaces 162.

Figure 63:
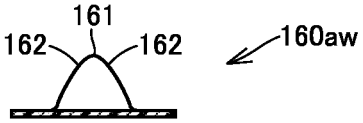
FIG. 63 is a diagram showing a protrusion in a shoe sole according to a forty-fifth modification as viewed in a direction orthogonal to a grip direction and an up-down direction.

FIG. 63 is a diagram showing a protrusion in a shoe sole according to a forty-fifth modification as viewed in a direction orthogonal to a grip direction and an up-down direction. As shown in FIG. 63, in the forty-fifth modification, a protrusion 160*aw* may not have a steeply inclined surface as in the forty-third modification, but may have a pair of inclined surfaces 162, each of which is curved in a protruding shape.

It should be noted that the protrusions 160*au*, 160*av*, and 160*aw* in the forty-third, forty-fourth, and forty-fifth modifications shown in FIGS. 61, 62, and 63, respectively, are not any of the first protrusion and the second protrusion in one embodiment of the present invention, but these protrusions may be further provided in the first exposed region and the second exposed region.

Each of the protrusions in the forty-first to forty-fifth modifications shown in FIGS. 59 to 63 is lower in grip force but higher in durability than the protrusion 160 in one embodiment shown in FIGS. 10 to 15. Further, the grip force of the protrusion increases in the order of the forty-fifth, forty-fourth, forty-third, forty-second, and forty-first modifications, and the durability of the protrusion increases in the order of forty-first, forty-second, forty-third, forty-fourth, and forty-fifth modifications.

Figure 64:
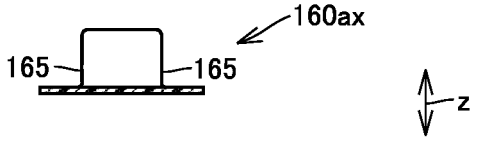
FIG. 64 is a diagram of a protrusion in a shoe sole according to a forty-sixth modification as viewed in a direction along a grip direction.

FIG. 64 is a diagram of a protrusion in a shoe sole according to a forty-sixth modification as viewed in a direction along a grip direction. As shown in FIG. 64, in a protrusion 160*ax* in the forty-sixth modification, the side inclined surface 165 may extend in the up-down direction z.

Figure 65:
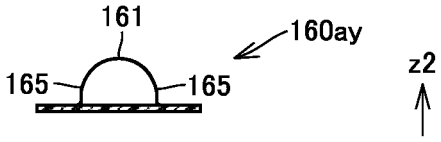
FIG. 65 is a diagram of a protrusion in a shoe sole according to a forty-seventh modification as viewed in a direction along a grip direction.

FIG. 65 is a diagram of a protrusion in a shoe sole according to a forty-seventh modification as viewed in a direction along a grip direction. As shown in FIG. 65, in a protrusion 160*ay* in the forty-seventh modification, the side inclined surface 165 may be curved in a protruding shape. Further, the tip end 161 of the protrusion 160*ay* may not linearly extend but may have a point-like outer shape as viewed from below.

Figure 66:
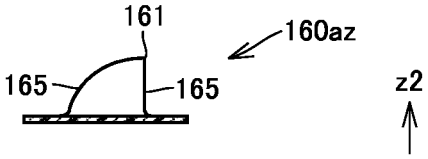
FIG. 66 is a diagram of a protrusion in a shoe sole according to a forty-eighth modification as viewed in a direction along a grip direction.

FIG. 66 is a diagram of a protrusion in a shoe sole according to a forty-eighth modification as viewed in a direction along a grip direction. As shown in FIG. 66, in a protrusion 160*az* in the forty-eighth modification, one of the paired side inclined surfaces 165 may extend in the up-down direction, and the other may be curved in a protruding shape. Further, the tip end 161 of the protrusion 160*az* may not linearly extend but may have a point-like outer shape as viewed from below.

Figure 67:
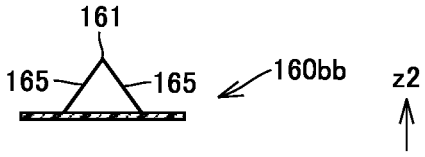
FIG. 67 is a diagram of a protrusion in a shoe sole according to a forty-ninth modification as viewed in a direction along a grip direction.

FIG. 67 is a diagram of a protrusion in a shoe sole according to a forty-ninth modification as viewed in a direction along a grip direction. As shown in FIG. 67, in a protrusion 160*ab* of the forty-ninth modification, the side inclined surface 165 as viewed in the grip direction may be linear, and the tip end 161 of the protrusion 160*ba* may not extend linearly but may have a point-like outer shape as viewed from below.

Figure 68:
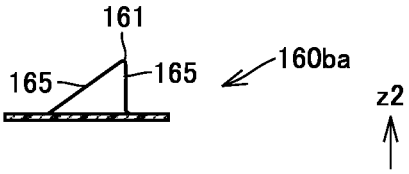
FIG. 68 is a diagram of a protrusion in a shoe sole according to a fiftieth modification as viewed in a direction along a grip direction.

FIG. 68 is a diagram of a protrusion in a shoe sole according to a fiftieth modification as viewed in a direction along a grip direction. As shown in FIG. 68, in a protrusion 160*bb* in the fiftieth modification, one pair of side inclined surfaces 165 may be inclined at different angles and may be linear when viewed in the grip direction.

Figure 69:
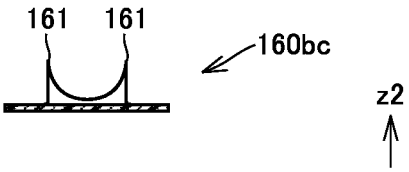
FIG. 69 is a diagram of a protrusion in a shoe sole according to a fifty-first modification as viewed in a direction along a grip direction.

FIG. 69 is a diagram of a protrusion in a shoe sole according to a fifty-first modification as viewed in a direction along a grip direction. As shown in FIG. 69, a protrusion 160*bc* in the fifty-first modification may have two tip ends 161 each having a point-like shape when viewed from below, and a ridgeline connecting the two tip ends 161 may be curved in a recessed shape when viewed in the grip direction.

Each of the protrusions 160*ax* to 160*bc* according to the modifications shown in FIGS. 64 to 69 may be the first protrusion or the second protrusion. The protrusions 160*ax* to 160*bc* according to the modifications shown in FIGS. 64 to 69 are lower in grip force but can be less in weight than the protrusion 160 shown in FIGS. 10 to 15. Further, the grip force of the protrusion can increase in the order of the fifty-first, fiftieth, forty-ninth, forty-eighth, forty-seventh, and forty-sixth modifications, and the weight of the protrusion can decrease in the order of the forty-sixth, forty-seventh, forty-eighth, forty-ninth, fiftieth, and fifty-first modifications.

In the above-described embodiments and modifications, the configurations that can be combined may be combined with each other.

The following describes a summary of the configurations of the above-described invention.

[Configuration 1]

A shoe sole having a front foot portion that supports a toe portion and a ball portion of a foot of a wearer, a middle foot portion that supports an arch portion of the foot; and a rear foot portion that supports a heel portion of the foot, the front foot portion, the middle foot portion, and the rear foot portion being connected in a front-rear direction, the shoe sole comprising:

a sole body portion located to continuously extend from the front foot portion to the rear foot portion; and a plate portion located to continuously extend from the front foot portion to the rear foot portion and joined to the sole body portion, the plate portion being formed of a material that is higher in rigidity than a material forming the sole body portion, wherein the plate portion has an exposed region that forms a ground contact surface of the shoe sole at least in the front foot portion, and an accommodated region that is accommodated inside the sole body portion at least in the rear foot portion, and in at least a part of the middle foot portion and at least a part of the rear foot portion, the plate portion is inclined upward as the plate portion extends rearward.

[Configuration 2]

The shoe sole according to configuration 1, wherein, from a front end to a rear end of the middle foot portion, the plate portion is inclined upward as the plate portion extends rearward.

[Configuration 3]

The shoe sole according to configuration 1, wherein, from a front end to a rear end of the rear foot portion, the plate portion is inclined upward as the plate portion extends rearward.

[Configuration 4]

The shoe sole according to configuration 1, wherein, in the plate portion, the accommodated region is entirely inclined upward as the accommodated region extends rearward.

[Configuration 5]

The shoe sole according to configuration 1, wherein the plate portion includes, in the exposed region, a plurality of protrusions protruding downward, and the exposed region includes a first exposed region located in at least a part of a portion of the shoe sole that supports a lateral foot side of the foot of the wearer, the first exposed region being provided with the protrusions, and a second exposed region located in at least a part of a portion of the shoe sole that supports a medial foot side of the foot of the wearer, the second exposed region being provided with the protrusions different in shape from the protrusions disposed in the first exposed region.

[Configuration 6]

The shoe sole according to configuration 5, wherein the protrusions located in the first exposed region include a plurality of first protrusions each having a first inclined surface located rearward of a tip end of a corresponding one of the first protrusions, and a first steeply inclined surface located forward of the tip end of the corresponding one of the first protrusions, the first steeply inclined surface being steeper than the first inclined surface, and the protrusions located in the second exposed region include a plurality of second protrusions each having a second inclined surface located forward of a tip end of a corresponding one of the second protrusions, and a second steeply inclined surface located rearward of the tip end of the corresponding one of the second protrusions, the second steeply inclined surface being steeper than the second inclined surface.

[Configuration 7]

The shoe sole according to configuration 6, wherein, in a region of the exposed region that supports an MP joint of the wearer, the first exposed region is located in the portion that supports the lateral foot side of the foot of the wearer, and the second exposed region is located in the portion that supports the medial foot side of the foot of the wearer.

[Configuration 8]

The shoe sole according to configuration 5, wherein the second exposed region is located in a region of the exposed region that is located in a front end portion of the plate portion.

[Configuration 9]

The shoe sole according to configuration 5, wherein the exposed region is located to continuously extend from the front foot portion to at least a part of the middle foot portion, and in a portion of the exposed region that is located on a front side in the middle foot portion, the first exposed region is located on the lateral foot side, and the second exposed region is located on the medial foot side.

[Configuration 10]

The shoe sole according to configuration 1, wherein a rear end of the exposed region is located in a portion that supports a lateral foot side of the foot of the wearer.

[Configuration 11]

The shoe sole according to configuration 1, wherein a rear end of the exposed region is located in a portion that supports a medial foot side of the foot of the wearer.

[Configuration 12]

The shoe sole according to configuration 1, wherein a rear end of the exposed region is located at a center of the shoe sole in a foot width direction.

[Configuration 13]

The shoe sole according to configuration 1, wherein, as viewed in an up-down direction, a dimension from a tip end of the shoe sole to a rear end of the exposed region in the front-rear direction is 20% or more and 75% or less of a dimension of the shoe sole in the front-rear direction.

[Configuration 14]

The shoe sole according to configuration 1, wherein in the middle foot portion, the plate portion has a narrow region in which a side edge on a medial foot side is curved in a shape recessed toward a center in a foot width direction, and in the narrow region, the plate portion is curved in a shape protruding downward.

[Configuration 15]

A shoe comprising:

the shoe sole according to configuration 1; and an upper located above the shoe sole.

[Configuration 16]

A shoe sole having a front foot portion that supports a toe portion and a ball portion of a foot of a wearer, a middle foot portion that supports an arch portion of the foot; and a rear foot portion that supports a heel portion of the foot, the front foot portion, the middle foot portion, and the rear foot portion being connected in a front-rear direction, the shoe sole comprising:

a sole body portion located to continuously extend from the front foot portion to the rear foot portion; and a plate portion extending at least in the front foot portion in the front-rear direction and joined to the sole body portion, the plate portion being formed of a material that is higher in rigidity than a material forming the sole body portion, wherein the plate portion includes a lateral foot side region that extends in the front-rear direction and supports a lateral foot side of the foot of the wearer, a medial foot side region that extends in the front-rear direction and supports a medial foot side of the foot of the wearer, and a rear side region that is located at least in a rear end portion of the plate portion and connects the lateral foot side region and the medial foot side region, and in the front foot portion, at least a part of the medial foot side region is spaced apart from the lateral foot side region in a foot width direction.

[Configuration 17]

The shoe sole according to configuration 16, wherein the plate portion further includes a tip end region that connects a front end of the lateral foot side region and a front end of the medial foot side region, the lateral foot side region and the medial foot side region being spaced apart from each other.

[Configuration 18]

The shoe sole according to configuration 17, wherein the plate portion has at least one beam portion spaced apart from both the tip end region and the rear side region, extending in the foot width direction, and connecting the lateral foot side region and the medial foot side region that are spaced apart from each other.

[Configuration 19]

The shoe sole according to configuration 18, wherein the plate portion has one of the at least one beam portion, and the one of the at least one beam portion is located closer to the rear side region than to the tip end region.

[Configuration 20]

The shoe sole according to configuration 17, wherein the plate portion has a mesh portion that connects, in a mesh-like manner, the lateral foot side region and the medial foot side region between the tip end region and the rear side region.

[Configuration 21]

The shoe sole according to configuration 16, wherein the plate portion is located to continuously extend from the front foot portion to the rear foot portion, the plate portion includes an exposed region that forms a ground contact surface of the shoe sole at least in the front foot portion, and an accommodated region that is accommodated inside the sole body portion at least in the rear foot portion, and in at least a part of the middle foot portion and at least a part of the rear foot portion, the plate portion is inclined upward as the plate portion extends rearward.

[Configuration 22]

The shoe sole according to configuration 21, wherein in the exposed region, the plate portion includes a plurality of protrusions protruding downward, and the exposed region includes a first exposed region located in at least a part of a portion of the shoe sole that supports the lateral foot side of the foot of the wearer, the first exposed region being provided with the protrusions, and a second exposed region located in at least a part of a portion of the shoe sole that supports the medial foot side of the foot of the wearer, the second exposed region being provided with the protrusions different in shape from the protrusions disposed in the first exposed region.

[Configuration 23]

The shoe sole according to configuration 22, wherein the protrusions located in the first exposed region include a plurality of first protrusions each having a first inclined surface located rearward of a tip end of a corresponding one of the first protrusions, and a first steeply inclined surface located forward of the tip end of the corresponding one of the first protrusions, the first steeply inclined surface being steeper than the first inclined surface, and the protrusions located in the second exposed region include a plurality of second protrusions each having a second inclined surface located forward of a tip end of a corresponding one of the second protrusions, and a second steeply inclined surface located rearward of the tip end of the corresponding one of the second protrusions, the second steeply inclined surface being steeper than the second inclined surface.

[Configuration 24]

The shoe sole according to configuration 23, wherein, in a region of the exposed region that supports an MP joint of the wearer, the first exposed region is located in a portion that supports the lateral foot side of the foot of the wearer, and the second exposed region is located in a portion that supports the medial foot side of the foot of the wearer.

[Configuration 25]

The shoe sole according to configuration 22, wherein the second exposed region is located in a region of the exposed region that is located in a front end portion of the plate portion.

[Configuration 26]

The shoe sole according to configuration 22, wherein the exposed region is located to continuously extend from the front foot portion to at least a part of the middle foot portion, and in a portion of the exposed region that is located on a front side in the middle foot portion, the first exposed region is located on the lateral foot side and the second exposed region is located on the medial foot side.

[Configuration 27]

The shoe sole according to configuration 21, wherein a rear end of the exposed region is located at a portion that supports a lateral foot side of the foot of the wearer.

[Configuration 28]

The shoe sole according to configuration 22, wherein a rear end of the exposed region is located at a portion that supports a medial foot side of the foot of the wearer.

[Configuration 29]

The shoe sole according to configuration 21, wherein a rear end of the exposed region is located at a center of the shoe sole in a foot width direction.

[Configuration 30]

The shoe sole according to configuration 21, wherein, as viewed in an up-down direction, a dimension from a tip end of the shoe sole to a rear end of the exposed region in the front-rear direction is 20% or more and 75% or less of a dimension of the shoe sole in the front-rear direction.

[Configuration 31]

The shoe sole according to configuration 21, wherein in the middle foot portion, the plate portion has a narrow region in which a side edge on a medial foot side is curved in a shape recessed toward a center in a foot width direction, and in the narrow region, the plate portion is curved in a shape protruding downward.

[Configuration 32]

A shoe including:

the shoe sole according to configuration 16; and an upper located above the shoe sole.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A shoe sole including a front foot portion configured to support a toe portion and a ball portion of a foot of a wearer, a middle foot portion configured to support an arch portion of the foot, and a rear foot portion configured to support a heel portion of the foot;

the front foot portion, the middle foot portion, and the rear foot portion being connected in a front-rear direction, the shoe sole comprising:

a sole body portion located to continuously extend from the front foot portion to the rear foot portion; and a plate located to continuously extend from the front foot portion to the rear foot portion and joined to the sole body portion, the plate being formed of a material that is higher in rigidity than a material forming the sole body portion, wherein the plate includes:

an exposed region that forms a ground contact surface of the shoe sole at least in the front foot portion, wherein the plate defines a plurality of protrusions extending downward from a bottom surface thereof in the exposed region, wherein the plurality of protrusions extending downward are each configured with the entire protrusion extending downward from the bottom surface of the plate;

an accommodated region that is accommodated inside the sole body portion at least in the rear foot portion; and in at least a part of the middle foot portion and at least a part of the rear foot portion, the plate is inclined upward as the plate extends rearward.

2. The shoe sole according to claim 1, wherein, from a front end to a rear end of the middle foot portion, the plate is inclined upward as the plate extends rearward.

3. The shoe sole according to claim 1, wherein, from a front end to a rear end of the rear foot portion, the plate is inclined upward as the plate extends rearward.

4. The shoe sole according to claim 1, wherein, in the plate, the accommodated region is entirely inclined upward as the accommodated region extends rearward.

5. The shoe sole according to claim 1, wherein:

the plurality of protrusions defined by the plate includes, in the exposed region, first protrusions and second protrusions protruding downward; and the exposed region includes:

a first exposed region located in at least a part of a portion of the shoe sole configured to support a lateral foot side of the foot of the wearer, the first exposed region being provided with the first protrusions, and a second exposed region located in at least a part of a portion of the shoe sole configured to support a medial foot side of the foot of the wearer, the second exposed region being provided with the second protrusions, the second protrusions different in shape from the first protrusions disposed in the first exposed region.

6. The shoe sole according to claim 5, wherein:

the first protrusions located in the first exposed region each include:

a first inclined surface located rearward of a tip end of a corresponding one of the first protrusions, and a first steeply inclined surface located forward of the tip end of the corresponding one of the first protrusions, the first steeply inclined surface being steeper than the first inclined surface, and the second protrusions located in the second exposed region each include:

a second inclined surface located forward of a tip end of a corresponding one of the second protrusions, and a second steeply inclined surface located rearward of the tip end of the corresponding one of the second protrusions, the second steeply inclined surface being steeper than the second inclined surface.

7. The shoe sole according to claim 6, wherein, in a region of the exposed region configured to support a metatarsal phalangeal (MP) joint of the wearer, the first exposed region is located in the portion configured to support the lateral foot side of the foot of the wearer, and the second exposed region is located in the portion configured to support the medial foot side of the foot of the wearer.

8. The shoe sole according to claim 5, wherein the second exposed region is located in a region of the exposed region that is located in a front end portion of the plate.

9. The shoe sole according to claim 5, wherein:

the exposed region is located to continuously extend from the front foot portion to at least a part of the middle foot portion, and in a portion of the exposed region that is located on a front side in the middle foot portion, the first exposed region is located on the lateral foot side, and the second exposed region is located on the medial foot side.

10. The shoe sole according to claim 1, wherein a rear end of the exposed region is located in a portion configured to support a lateral foot side of the foot of the wearer.

11. The shoe sole according to claim 1, wherein a rear end of the exposed region is located in a portion configured to support a medial foot side of the foot of the wearer.

12. The shoe sole according to claim 1, wherein a rear end of the exposed region is located at a center of the shoe sole in a foot width direction.

13. The shoe sole according to claim 1, wherein, as viewed in an up-down direction, a dimension from a tip end of the shoe sole to a rear end of the exposed region in the front-rear direction is 20% or more and 75% or less of a dimension of the shoe sole in the front-rear direction.

14. The shoe sole according to claim 1, wherein:

in the middle foot portion, the plate includes a narrow region in which a side edge on a medial foot side is curved in a shape recessed toward a center in a foot width direction, and in the narrow region, the plate is curved in a shape protruding downward.

15. A shoe comprising:

the shoe sole according to claim 1; and an upper located above the shoe sole.

16. A shoe sole including a front foot portion that is configured to support a toe portion and a ball portion of a foot of a wearer, a middle foot portion that is configured to support an arch portion of the foot, and a rear foot portion that is configured to support a heel portion of the foot;

the front foot portion, the middle foot portion, and the rear foot portion being connected in a front-rear direction, the shoe sole comprising:

a sole body portion including a first body portion and a second body portion, the first body portion located to continuously extend from the front foot portion to the rear foot portion, the first body portion positioned above the second body portion;

a plate extending at least in the front foot portion in the front-rear direction and joined to the sole body portion, the plate being formed of a material that is higher in rigidity than a material forming the first body portion of the sole body portion, the first body portion positioned above the plate, wherein the plate includes:

a lateral foot side region that extends in the front-rear direction and is configured to support a lateral foot side of the foot of the wearer;

a medial foot side region that extends in the front-rear direction and is configured to support a medial foot side of the foot of the wearer; and a rear side region that is located at least in a rear end portion of the plate and connects the lateral foot side region and the medial foot side region; and in the front foot portion, at least a part of the medial foot side region of the plate is spaced apart from the lateral foot side region of the plate in a foot width direction so that a gap in the plate is present therebetween, the gap extending from the medial foot side region of the plate to the lateral foot side region of the plate, wherein a part of the first body portion of the sole body portion is exposed in the gap.

17. The shoe sole according to claim 16, wherein the plate further includes a tip end region that connects a front end of the lateral foot side region and a front end of the medial foot side region.

18. A shoe comprising:

the shoe sole according to claim 16; and an upper located above the shoe sole.

19. A shoe sole including a front foot portion that is configured to support a toe portion and a ball portion of a foot of a wearer, a middle foot portion that is configured to support an arch portion of the foot, and a rear foot portion that is configured to support a heel portion of the foot;

the front foot portion, the middle foot portion, and the rear foot portion being connected in a front-rear direction, the shoe sole comprising:

a sole body portion including a first body portion and a second body portion, the first body portion located to continuously extend from the front foot portion to the rear foot portion, the first body portion positioned above the second body portion;

a plate extending at least in the front foot portion in the front-rear direction and joined to the sole body portion, the plate being formed of a material that is higher in rigidity than a material forming the first body portion of the sole body portion, the first body portion positioned above the plate, wherein the plate includes:

an exposed region that forms a ground contact surface of the shoe sole at least in the front foot portion, the exposed region including a plurality of protrusions extending therefrom;

an accommodated region that is accommodated inside the sole body portion at least in the rear foot portion;

a lateral foot side region that extends in the front-rear direction and is configured to support a lateral foot side of the foot of the wearer;

a medial foot side region that extends in the front-rear direction and is configured to support a medial foot side of the foot of the wearer; and a rear side region that is located at least in a rear end portion of the plate and connects the lateral foot side region and the medial foot side region; and in the front foot portion, at least a part of the medial foot side region of the plate is spaced apart from the lateral foot side region of the plate in a foot width direction so that a gap in the plate is present therebetween, wherein a part of the first body portion of the sole body portion is exposed in the gap, wherein the plurality of protrusions are positioned outside of the gap, and wherein the gap is in the exposed region of the plate.

20. The shoe sole according to claim 19, wherein:

in the exposed region, the plurality of protrusions positioned outside of the gap includes first protrusions and second protrusions protruding downward; and the exposed region includes:

a first exposed region located in the lateral foot side region, the first exposed region being provided with the first protrusions, and a second exposed region located in the medial foot side region, the second exposed region being provided with the second protrusions, the second protrusions different in shape from the first protrusions disposed in the first exposed region.

21. A shoe comprising:

the shoe sole according to claim 19; and an upper located above the shoe sole.

* * * * *